US008662868B2

(12) United States Patent
Oikawa et al.

(10) Patent No.: US 8,662,868 B2
(45) Date of Patent: Mar. 4, 2014

(54) DAMPER DEVICE AND HIGH PRESSURE PUMP HAVING THE SAME

(75) Inventors: Shinobu Oikawa, Kariya (JP); Hiroatsu Yamada, Nagoya (JP); Hiroshi Inoue, Anjo (JP)

(73) Assignee: Denso Corporation, Kariya (JP)

( * ) Notice: Subject to any disclaimer, the term of this patent is extended or adjusted under 35 U.S.C. 154(b) by 762 days.

(21) Appl. No.: 12/706,160

(22) Filed: Feb. 16, 2010

(65) Prior Publication Data

US 2010/0209274 A1 Aug. 19, 2010

(30) Foreign Application Priority Data

Feb. 13, 2009 (JP) ..... 2009-31081
Nov. 9, 2009 (JP) ..... 2009-256379

(51) Int. Cl.
*F04B 11/00* (2006.01)

(52) U.S. Cl.
USPC ..... 417/540

(58) Field of Classification Search
USPC ..... 417/540; 123/446, 467; 138/26, 30
See application file for complete search history.

(56) References Cited

U.S. PATENT DOCUMENTS

2003/0164161 A1 9/2003 Usui et al.
2005/0019188 A1* 1/2005 Usui et al. ..... 417/540
2008/0289713 A1* 11/2008 Munakata et al. ..... 138/26

FOREIGN PATENT DOCUMENTS

JP 2004-138071 5/2004
JP 2008-286144 11/2008

OTHER PUBLICATIONS

Japanese Office Action dated Jan. 4, 2011, issued in corresponding Japanese Application No. 2009-256379 with English Translation.

* cited by examiner

*Primary Examiner* — Charles Freay
*Assistant Examiner* — Philip Stimpert
(74) *Attorney, Agent, or Firm* — Nixon & Vanderhye P.C.

(57) ABSTRACT

In a housing, a damper member is placed in a fluid chamber communicated with a pressurizing chamber, at which a plunger is reciprocated to pressurize fuel, and an opening of the fluid chamber is covered with a cover member. The damper member includes first and second-side diaphragms. A first-side support member is located between the damper member and the cover member and is engaged with a first-side outer peripheral portion of the first-side diaphragm and the cover member. A second-side support member is located between the damper member and the housing and is engaged with a second-side outer peripheral portion of the second-side diaphragm and the housing. The first and second-side support members are urged between the housing and the cover member.

13 Claims, 12 Drawing Sheets

DAMPER DEVICE AND HIGH PRESSURE PUMP HAVING THE SAME

CROSS REFERENCE TO RELATED APPLICATION

This application is based on and incorporates herein by reference Japanese Patent Application No. 2009-31081 filed on Feb. 13, 2009 and Japanese Patent Application No. 2009-256379 filed on Nov. 9, 2009.

BACKGROUND OF THE INVENTION

1. Field of the Invention

The present invention relates to a damper device and a high pressure pump having the same.

2. Description of Related Art

In a case of a known high pressure pump for an internal combustion engine of a vehicle, fuel is pumped to the high pressure pump from a fuel pump, which is placed in a fuel tank, through a low pressure fuel conduit. Then, the high pressure pump pressurizes the received fuel through reciprocating movement of a plunger and then discharges the pressurized fuel toward injectors.

In the high pressure pump of this kind, a portion of the fuel in the pressurizing chamber, in which the fuel is pressurized by the plunger, is discharged to a fluid chamber that is provided at a fuel inlet side. A damper device, which includes a damper member, is placed in the fluid chamber to reduce the pressure pulsation that is generated by the fuel discharged into the fluid chamber.

In a case of another damper device disclosed in Japanese Patent No. 3823060 B2 (corresponding to US 2003/0164161 A1), a damper member, which includes two metal diaphragms, is placed in a fluid chamber and is urged between a cover member and a housing.

In a case of a damper device disclosed in Japanese Patent No. 4036153 B2 (corresponding to US 2005/0019188 A1), a damper member, which includes two metal diaphragms, is installed in a fluid chamber and is secured by components, such as a wavy spring, a washer guide and a washer.

However, in the case of Japanese Patent No. 3823060 B2, it is difficult to form a sufficient space for conducting the fuel at a location radially outward of the damper member. The fuel, which is discharged from the pressurizing chamber, flows toward the fuel inlet upon flowing along a surface of the damper member on one side of the damper member. Therefore, a sufficient pressure pulsation reducing performance of the damper member may possibly not be implemented.

The wavy spring has the following characteristic. That is, when the wavy spring is axially pressed, the wavy spring radially outwardly expands. Thus, in the case of Japanese Patent No. 3823060 B2, the radially outward displacement (expansion) of the wavy spring may be limited by the inner wall of the fluid chamber. Therefore, a uniform load may not be applied from the wavy spring to the damper member to cause torsion or twist of the damper member, and thereby it may possibly be difficult to achieve the sufficient pressure pulsation reducing performance of the damper member.

In the case of the damper device of Japanese Patent No. 4036153 B2, the number of components, which are required to install the damper member in the fuel chamber, is disadvantageously increased.

SUMMARY OF THE INVENTION

The present invention addresses the above disadvantage. According to the present invention, there is provided a high pressure pump, which includes a plunger, a housing, a delivery valve, a metering valve, a cover member, a damper member, a first-side support member, a second-side support member and an annular resilient member. The plunger is adapted to reciprocate in an axial direction. The housing includes a pressurizing chamber and a fluid chamber. The plunger pressurizes fuel in the pressurizing chamber through reciprocating movement of the plunger, and the pressurizing chamber is communicated with the fluid chamber. The delivery valve discharges the fuel, which is pressurized to a predetermined pressure or higher in the pressurizing chamber, through a fuel outlet. The metering valve discharges a portion of the fuel from the pressurizing chamber to the fluid chamber by opening or closing a fuel passage, which communicates between the pressurizing chamber and the fluid chamber, when a volume of the pressurizing chamber is reduced by the plunger. The cover member covers an opening of the fluid chamber, which is formed in the housing. The damper member is placed in the fluid chamber and includes a first-side diaphragm and a second-side diaphragm. A first-side outer peripheral portion of the first-side diaphragm and a second-side outer peripheral portion of the second-side diaphragm are joined together to form a sealed damper chamber between the first-side diaphragm and the second-side diaphragm. The first-side support member supports the first-side outer peripheral portion of the damper member from a cover member side of the first-side outer peripheral portion in the axial direction. The second-side support member supports the second-side outer peripheral portion of the damper member from a housing side of the second-side outer peripheral portion in the axial direction. The annular resilient member is placed between the cover member and the first-side support member to urge the first-side support member against the first-side outer peripheral portion and to urge the second-side support member against the housing through the damper member. The first-side support member includes an annular support portion at a cover member side of the first-side support member to support both of an inner peripheral surface and a housing side surface of the annular resilient member.

There is also provided a damper device, which includes a housing, a cover member, a damper member, a first-side support member and a second-side support member. The housing has an opening at one end of the housing. The cover member covers the opening and forms a fluid chamber in corporation with the housing. The fluid chamber is adapted to conduct fluid therethrough. The damper member includes a first-side diaphragm and a second-side diaphragm. A first-side outer peripheral portion of the first-side diaphragm and a second-side outer peripheral portion of the second-side diaphragm are joined together to form a sealed damper chamber between an outwardly concaved surface of the first-side diaphragm and an outwardly concaved surface of the second-side diaphragm. The first-side support member is located between the damper member and the cover member and is engaged with the first-side outer peripheral portion and the cover member. The second-side support member is located between the damper member and the housing and is engaged with the second-side outer peripheral portion and the housing. At least one of the first-side support member and the second-side support member is configured to be resiliently deformable between the housing and the cover member. The first-side support member and the second-side support member are urged between the housing and the cover member to clamp the first-side outer peripheral portion and the second-side outer peripheral portion therebetween and thereby to support the damper member between the housing and the cover member.

There is also provided a high pressure pump, which includes the damper device described above. The housing includes a pressurizing chamber, which is communicated with the fluid chamber. A plunger, which is adapted to reciprocate, pressurizes fluid in the pressurizing chamber through reciprocating movement of the plunger.

DETAILED DESCRIPTION OF THE INVENTION

First Embodiment

Figure 1:
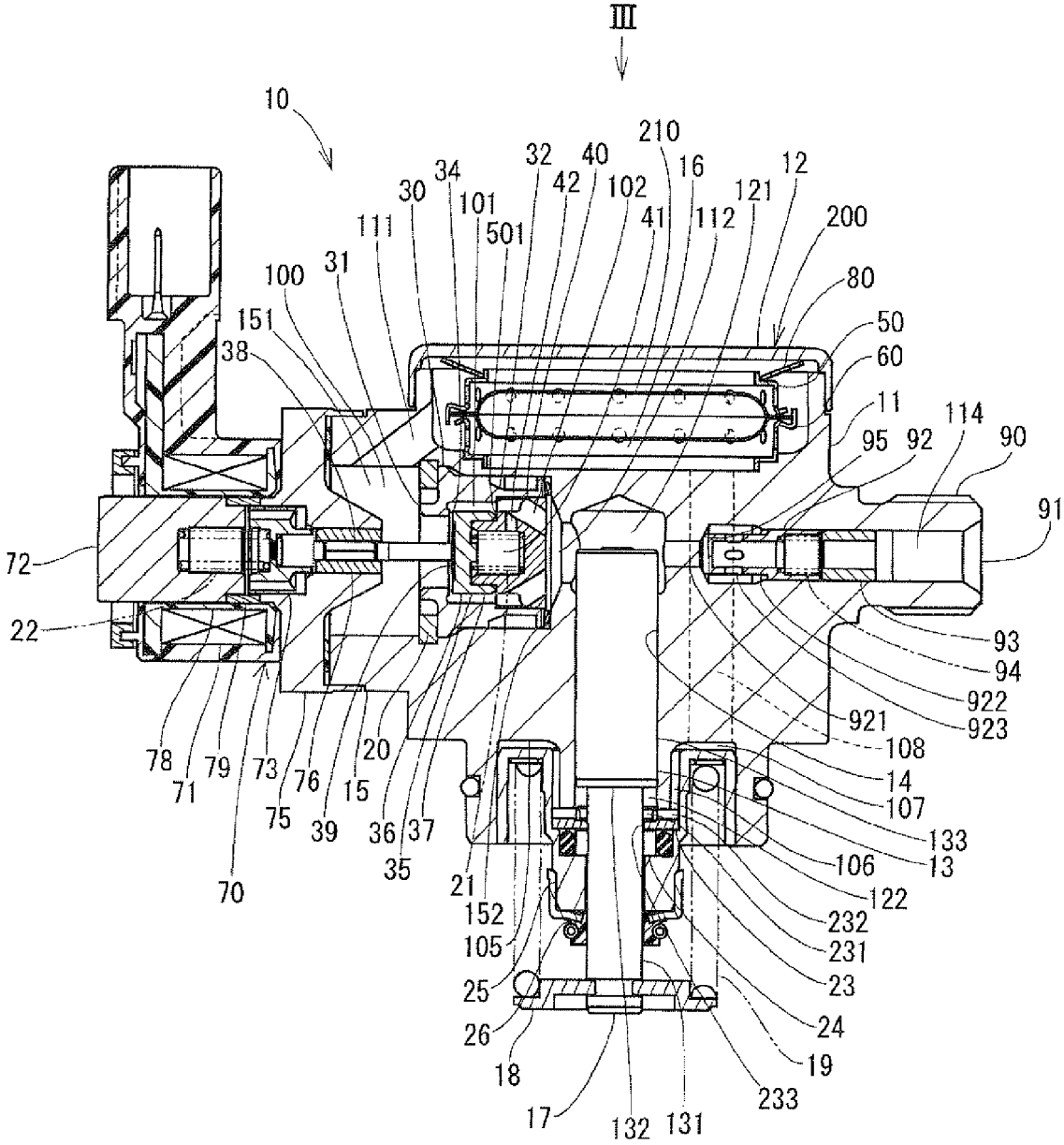
FIG. 1 is a cross-sectional view of a high pressure pump according to a first embodiment of the present invention.

A high pressure pump according to a first embodiment of the present invention supplies fuel to, for example, an injector of a gasoline engine or a diesel engine of a vehicle through a delivery pipe. As shown in FIG. 1, the high pressure pump 10 includes a housing 11, a cover member 12, a plunger 13, a valve body 30, an electromagnetic drive device 70, a delivery valve arrangement 90 and a damper device 200.

The housing 11 is made of, for example, martensitic stainless steel. The housing 11 forms a cylinder 14. A plunger 13 is slidably supported in the cylinder 14 in a manner that enables axial reciprocating movement of the plunger 13 in the cylinder 14.

The housing 11 forms a guide passage 111, an intake passage 112, a pressurizing chamber 121 and a delivery passage 114. The housing 11 has a tubular portion 15. The tubular portion 15 forms a passage 151, which communicates between the guide passage 111 and the intake passage 112. The tubular portion 15 extends in a direction generally perpendicular to a central axis of the cylinder 14. An inner diameter of the tubular portion 15 changes along a length of the tubular portion 15. In the housing 11, a stepped surface 152 is formed in the interior of the tubular portion 15 at a location where the inner diameter of the tubular portion 15 changes. A valve body 30 is provided in the passage 151, which is formed in the tubular portion 15.

A fluid chamber 16 is formed between the housing 11 and the cover member 12. A damper member 210 of the damper device 200 is clamped between a first-side support member 50 and a second-side support member 60, which are, in turn, urged against the housing 11 through a Belleville spring 80. In this way, the damper member 210 is supported between the housing 11 and the cover member 12. The damper device 200 will be described in detail later. A fuel inlet (not shown) is formed in the fluid chamber 16 and is communicated with a low pressure fuel conduit (not shown). A low pressure fuel pump (not shown) pumps fuel out of a fuel tank and supplies the fuel to the fluid chamber 16 through the low pressure fuel conduit and the fuel inlet. The guide passage 111 communicates between the fluid chamber 16 and the passage 151 of the tubular portion 15. One end part of the intake passage 112 is communicated with the pressurizing chamber 121. The other end part of the intake passage 112 is opened on an inner peripheral side of the stepped surface 152. The guide passage 111 and the intake passage 112 are communicated with each other through the interior of the valve body 30. The pressurizing chamber 121 is communicated with the delivery passage 114 at a different operational phase that is different from an operational phase, in which the pressurizing chamber 121 is communicated with the intake passage 112. In the present embodiment, these fuel passages are also collectively referred to as a fuel passage 100.

The plunger 13 is supported in the cylinder 14 of the housing 11 in such a manner that the plunger 13 is axially reciprocatable in the cylinder 14. The plunger 13 has a small diameter portion 131 and a large diameter portion 133. The large diameter portion 133 has an outer diameter, which is larger than an outer diameter of the small diameter portion 131. The large diameter portion 133 is connected to a pressurizing chamber 121 side end of the small diameter portion 131 and forms a stepped surface 132 between the large diameter portion 133 and the small diameter portion 131. The pressurizing chamber 121 is formed at an end of the large diameter portion 133, which is opposite from the small diameter portion 131. A plunger stopper 23, which is configured into a generally annular form and is engaged with the housing 11, is provided on one side of the stepped surface 132 of the plunger 13, which is opposite from the pressurizing chamber 121.

The plunger stopper 23 has a recess 231 and a groove passage 232. The recess 231 is configured into an annular form and is recessed in a pressurizing chamber 121 side end surface of the plunger stopper 23 in a direction, which is opposite from the pressurizing chamber 121. The groove passage 232 extends radially outwardly from the recess 231 to an outer peripheral edge part of the plunger stopper 23. A diameter of the recess 231 is larger than the outer diameter of the large diameter portion 133 of the plunger 13. A through hole 233 is formed at a center portion of the recess 231 to extend through the plunger stopper 23 in a thickness direction of the plunger stopper 23 (i.e., in the axial direction of the plunger 13). The small diameter portion 131 of the plunger 13 is received through the hole 233 of the plunger stopper 23, and the pressurizing chamber 121 side end surface of the plunger stopper 23 is engaged with the housing 11. In this way, a variable volume chamber 122, which is configured into a generally annular shape, is defined by the stepped surface 132 of the plunger 13, an outer peripheral wall of the small diameter portion 131, an inner peripheral wall of the cylinder 14, the recess 231 of the plunger stopper 23 and a seal member 24.

A recess 105, which is configured into a generally annular form, is recessed in an end part of the housing 11, which is opposite from the pressurizing chamber 121, at a location radially outward of the cylinder 14. An oil seal holder 25 is fitted into the recess 105. The oil seal holder 25 is fixed to the housing 11 while the seal member 24 is clamped between the oil seal holder 25 and the plunger stopper 23. The seal member 24 includes a Teflon ring (Teflon is a registered trademark and brand name of the DuPont company) and an O-ring. The O-ring is placed radially outward of the Teflon ring. The seal member 24 limits a thickness of a fuel oil film around the small diameter portion 131 and limits leakage of fuel toward the engine, which would be induced by the slide movement of the plunger 13. An oil seal 26 is installed to an end part of the oil seal holder 25, which is opposite from the pressurizing chamber 121. The oil seal 26 limits a thickness of an oil film around the small diameter portion 131 and also limits leakage of the oil, which would be induced by the slide movement of the plunger 13.

Annular passages 106, 107 are formed between the oil seal holder 25 and the housing 11. The passage 106 and the passage 107 are communicated with each other. A passage 108, which communicates between the passage 107 and the fluid chamber 16, is formed in the housing 11. The passage 106 and the groove passage 232 of the plunger stopper 23 are communicated with each other. The groove passage 232, the passage 106, the passage 107 and the passage 108 are communicated in the above described manner to communicate the variable volume chamber 122 with the fluid chamber 16.

A head 17, which is provided at the other end of the small diameter portion 131 that is opposite from the large diameter portion 133, is connected to a spring seat 18. A spring 19 is placed between the spring seat 18 and the oil seal holder 25. The spring seat 18 is urged downwardly in FIG. 1 toward a cam (not shown) by an urging force of the spring 19. The plunger 13 is engaged with the cam through a tappet (not shown) and is thereby reciprocated by the cam. One end part of the spring 19 is engaged with the oil seal holder 25, and the other end part of the spring 19 is engaged with the spring seat 18. The spring 19 exerts an axial resilient force. In this way, the spring 19 urges the tappet (not shown) toward the cam through the spring seat 18.

The volume of the variable volume chamber 122 is changed in response to the reciprocating movement of the plunger 13. The fuel is drawn into the variable volume chamber 122 from the fluid chamber 16 (the fluid chamber 16 being communicated with the fuel passage 100) through the passage 108, the passage 107, the passage 106 and the groove passage 232 when the volume of the variable volume chamber 122 is increased upon the upward movement of the plunger 13 in a metering stroke or a pressurizing stroke of the plunger 13. In the metering stroke of the plunger 13, a portion of the low pressure fuel, which is discharged from the pressurizing chamber 121, can be drawn into the variable volume chamber 122. In this way, even when fuel pressure pulsation occurs due to the discharge of the fuel from the pressurizing chamber 121, it is possible to limit transmission of the fuel pressure pulsation to the low pressure fuel conduit.

The fuel is discharged from the variable volume chamber 122 to the fluid chamber 16 when the volume of the variable volume chamber 122 is decreased upon the increase of the volume of the pressurizing chamber 121 caused by the downward movement of the plunger 13 in the intake stroke in FIG. 1. Here, the volume of the pressurizing chamber 121 and the volume of the variable volume chamber 122 are determined solely by the position of the plunger 13. Therefore, the fuel is discharged from the variable volume chamber 122 to the fluid chamber 16 at the time of drawing of the fuel into the pressurizing chamber 121, so that the quantity of fuel, which is drawn into the pressurizing chamber 121 through the fuel passage 100, is increased. Thereby, a fuel suctioning efficiency for suctioning, i.e., drawing the fuel into the pressurizing chamber 121 is improved.

The delivery valve arrangement 90, which is provided to the delivery passage 114 side portion of the housing 11, enables or disables the discharge of the pressurized fuel from the pressurizing chamber 121. The delivery valve arrangement 90 includes a check valve 92, a limiting member 93 and a spring 94. The check valve 92 includes a bottom portion 921 and a tubular portion 922 extending from the bottom portion 921 on a side opposite from the pressurizing chamber 121 and is thereby configured into a cup shape. The check valve 92 is reciprocatable and placed in the delivery passage 114. The limiting member 93 is configured into a tubular form and is fixed to the housing 11, which forms the delivery passage 114. One end part of the spring 94 is engaged with the limiting member 93, and the other end part of the spring 94 is engaged with the tubular portion 922 of the check valve 92. The check valve 92 is urged toward a valve seat 95, which is formed in the housing 11, by the urging force of the spring 94. When the bottom portion 921 side end part of the check valve 92 is seated against the valve seat 95, the check valve 92 closes the delivery passage 114. In contrast, when the bottom portion 921 side end part of the check valve 92 is lifted away from the valve seat 95, the delivery passage 114 is opened. When the check valve 92 is moved in the direction opposite from the valve seat 95, the end part of the tubular portion 922, which is opposite from the bottom portion 921, is engaged with the limiting member 93 to limit further movement of the check valve 92.

When the pressure of the fuel in the pressurizing chamber 121 is increased, the force, which is applied to the check valve 92 from the fuel at the pressurizing chamber 121 side, is increased. When the force, which is applied to the check valve 92 from the fuel at the pressurizing chamber 121 side, becomes larger than a sum of the urging force of the spring 94 and the force, which is applied to the check valve 92 from the fuel on the downstream side of the valve seat 95, i.e., the fuel in a delivery pipe (not shown), the check valve 92 is lifted away from the valve seat 95. In this way, the fuel in the pressurizing chamber 121 is discharged out of the high pressure pump 10 through the fuel outlet 91 upon passing through radial through holes 923 of the tubular portion 922 and an interior of the tubular portion 922 in the check valve 92.

When the pressure of the fuel in the pressurizing chamber 121 is reduced, the force, which is applied to the check valve 92 from the fuel at the pressurizing chamber 121 side, is reduced. When the force, which is applied to the check valve 92 from the fuel in the pressurizing chamber 121, becomes smaller than the sum of the urging force of the spring 94 and the force, which is applied to the check valve 92 from the fuel on the downstream side of the valve seat 95, the check valve 92 is seated against the valve seat 95. In this way, it is possible to limit the outflow of the fuel from the interior of the delivery pipe (not shown) into the pressurizing chamber 121 through the delivery passage 114.

The valve body 30 is fixed to the interior of the passage 151 of the housing 11 by, for example, press-fitting of the valve body 30 into the passage 151 and also by use of an engaging member 20. The valve body 30 includes a valve seat portion 31 and a tubular portion 32. The valve seat portion 31 is configured into a generally annular form, and the tubular portion 32 is configured into a tubular form and extends from the valve seat portion 31 toward the pressurizing chamber 121. A valve seat 34 is configured into an annular form and is formed in a pressurizing chamber 121 side wall surface of the valve seat portion 31.

A valve member 35, which is formed as a metering valve, is placed radially inward of the tubular portion 32 of the valve body 30. The valve member 35 includes a circular disk portion 36 and a guide portion 37. The circular disk portion 36 is configured into a generally circular plate form. The guide portion 37 is configured into a hollow tubular form and extends from an outer peripheral edge part of the circular disk portion 36 toward the pressurizing chamber 121. The valve member 35 has a recess 39, which is configured into a generally circular flat form at a valve seat 34 side end part of the circular disk portion 36 and is recessed in a direction opposite from the valve seat 34. An inner peripheral wall of the valve member 35, which forms the recess 39, is tapered such that an inner diameter of the inner peripheral wall of the valve member 35 is progressively decreased toward the pressurizing chamber 121. An annular fuel passage 101, which forms a part of the fuel passage 100, is defined between the inner peripheral wall of the tubular portion 32 and the outer peripheral wall of the circular disk portion 36 and of the guide portion 37. The valve member 35 enables and disables the flow of fuel in the fuel passage 100 by disengaging and engaging the circular disk portion 36 relative to the valve seat 34 through the reciprocating movement of the valve member 35. The recess 39 receives the dynamic pressure of fuel, which flows from the passage 151 to the annular fuel passage 101.

The stopper 40 is provided on a pressurizing chamber 121 side of the valve member 35. The stopper 40 is fixed to the inner peripheral wall of the tubular portion 32 of the valve body 30.

An inner diameter of the guide portion 37 of the valve member 35 is set to be slightly larger than an outer diameter of a valve member 35 side end part of the stopper 40. Therefore, the inner peripheral wall of the guide portion 37 slides over the outer peripheral wall of the stopper 40 when the valve member 35 is reciprocated in a valve opening direction (i.e., a direction away from the valve seat 34) or a valve closing direction (i.e., a direction toward the vale seat 34). In this way, the reciprocating movement of the valve member 35 in the valve opening direction or the valve closing direction is guided.

A spring 21 is provided between the stopper 40 and the valve member 35. The spring 21 is placed radially inward of the guide portion 37 of the valve member 35 and also radially inward of the stopper 40. One end part of the spring 21 is engaged with the inner wall of the stopper 40, and the other end part of the spring 21 is engaged with the circular disk portion 36 of the valve member 35. The spring 21 has an axial expansion force (resilient force) to urge the valve member 35 in a direction opposite from the stopper 40, i.e., in the valve closing direction.

A pressurizing chamber 121 side end part of the guide portion 37 of the valve member 35 is engageable with a stepped surface 501, which is provided in the outer wall of the stopper 40. When the valve member 35 is engaged with the stepped surface 501, the stopper 40 limits further movement of the valve member 35 toward the pressurizing chamber 121, i.e., further movement of the valve member 35 in the valve opening direction. When the stopper 40 is axially viewed from the pressurizing chamber 121 side thereof, the stopper 40 covers the pressurizing chamber 121 side wall surface of the valve member 35. In this way, it is possible to limit the influence of the dynamic pressure, which is generated by the flow of low pressure fuel from the pressurizing chamber 121 side toward the valve member 35 side in the metering stroke of the plunger 13, on the valve member 35. Furthermore, a volume chamber 41 is formed between stopper 40 and the valve member 35. A volume of the volume chamber 41 is changed by the reciprocating movement of the valve member 35.

A plurality of passages 102 is formed in the stopper 40 in such a manner that each passage 102 is declined relative to the axis of the stopper 40 and communicates between the annular fuel passage 101 and the intake passage 112. The passages 102 are arranged one after another in the circumferential direction of the stopper 40. Furthermore, a conduit 42, which communicates between the volume chamber 41 and the annular fuel passage 101, is formed in the stopper 40. Therefore, fuel in each passage 102, which is communicated with the annular fuel passage 101, can flow into the volume chamber 41 through the conduit 42.

The fuel passage 100 includes the annular fuel passage 101 and the passage 102. Thereby, the fuel passage 100 communicates between the fluid chamber 16 and the pressurizing chamber 121. When fuel flows from the fluid chamber 16 side toward the pressurizing chamber 121 side, the fuel passes the guide passage 111, the passage 151, the annular fuel passage 101, the passage 102 and the intake passage 112 in this order. In contrast, when fuel flows from the pressurizing chamber 121 side toward the fluid chamber 16 side, the fuel flows through the intake passage 112, the passage 102, the annular fuel passage 101, the passage 151 and the guide passage 111 in this order.

The electromagnetic drive device 70 includes a coil 71, a stator core 72, a movable core 73 and a flange 75. The coil 71 is wound around a spool 78, which is made of resin. When the coil 71 is energized, the coil 71 generates a magnetic field. The stator core 72 is made of a magnetic material. The stator core 72 is received radially inward of the coil 71. The movable core 73 is made of a magnetic material. The movable core 73 is opposed to the stator core 72. The movable core 73 is received in a tubular member 79, which is made of a non-magnetic material, and also in the flange 75 in a manner that enables axial reciprocating movement of the movable core 73. The tubular member 79 limits the magnetic short-circuiting between the stator core 72 and the flange 75.

The flange 75 is made of a magnetic material and is installed to the tubular portion 15 of the housing 11. The flange 75 holds the electromagnetic drive device 70 relative to the housing 11 and closes an end part of the tubular portion 15. The flange 75 has a guide tube 76, which is provided at a center part of the flange 75 and is configured into a tubular form.

The needle 38 is configured into a generally cylindrical form and is placed radially inward of the guide tube 76. An inner diameter of the guide tube 76 is slightly larger than an outer diameter of the needle 38. In this way, the needle 38 slides along and reciprocates along the inner peripheral wall of the guide tube 76. Therefore, when the needle 38 reciprocates, the reciprocating movement of the needle 38 is guided by the guide tube 76.

One end part of the needle 38 is press fitted to or welded to the movable core 73, so that the needle 38 is installed integrally with the movable core 73. The other end part of the needle 38 is engageable with a valve seat 34 side wall surface of the circular disk portion 36 of the valve member 35.

A spring 22 is provided between the stator core 72 and the movable core 73. The spring 22 urges the movable core 73 toward the valve member 35. The urging force of the spring 22, which urges the movable core 73, is larger than the urging force of the spring 21, which urges the valve member 35. Specifically, the spring 22 urges the movable core 73 and the needle 38 toward the valve member 35, i.e., in the valve opening direction of the valve member 35 against the urging force of the spring 21. In this way, when the coil 71 is not energized, the stator core 72 and the movable core 73 are spaced from each other. Therefore, when the coil 71 is not energized, the needle 38, which is integrated with the movable core 73, is moved toward the valve member 35 by the urging force of the spring 22, and thereby the valve member 35 is lifted away from the valve seat 34 of the valve body 30. As discussed above, the needle 38 can urge the valve member 35 in the valve opening direction upon the engagement of the needle 38 against the circular disk portion 36 with the urging force of the spring 22.

Now, the operation of the high pressure pump 10 will be described. First of all, an intake stroke will be described. When the plunger 13 is moved downward in FIG. 1, the energization of the coil 71 is stopped. Therefore, the valve member 35 is urged toward the pressurizing chamber 121 by the needle 38, which is integral with the movable core 73 that receives the force from the spring 22. Thereby, the valve member 35 is lifted away from the valve seat 34 of the valve body 30. Furthermore, when the plunger 13 is moved downward in FIG. 1, the pressure of the pressurizing chamber 121 is decreased. As a result, the force, which is applied to the valve member 35 from the fuel on one side of the valve member 35 opposite from the pressurizing chamber 121, becomes larger than the force, which is applied to the valve member 35 from the fuel on the other side of the valve member 35 where the pressurizing chamber 121 is located. Thereby, the force is applied to the valve member 35 in the direction away from the valve seat 34, so that the valve member 35 is lifted away from the valve seat 34. The valve member 35 is moved until the guide portion 37 engages the stepped surface 501 of the stopper 40. When the valve member 35 is lifted away from the valve seat 34, i.e., when the valve member 35 is placed in a valve open state, fuel in the fluid chamber 16 is drawn into the pressurizing chamber 121 through the guide passage 111, the passage 151, the annular fuel passage 101, the passage 102 and the intake passage 112 in this order. Furthermore, at this time, the fuel in the passage 102 can flow into the volume chamber 41 through the conduit 42. Therefore, the pressure of the volume chamber 41 becomes equal to the pressure of the passage 102.

Next, a metering stroke will be discussed. When the plunger 13 is driven from the bottom dead center toward the top dead center, the flow of fuel, which is discharged from the pressurizing chamber 121 toward the fluid chamber 16, results in application of the force of fuel, which is located on the pressurizing chamber 121 side of the valve member 35, against the valve member 35 toward the valve seat 34. However, when the coil 71 is not energized, the needle 38 is urged toward the valve member 35 by the urging force of the spring 22. Therefore, the movement of the valve member 35 toward the valve seat 34 is limited by the needle 38. Furthermore, the pressurizing chamber 121 side wall surface of the valve member 35 is covered with the stopper 40. In this way, the direct application of the dynamic pressure, which is generated by the flow of fuel discharged from the pressurizing chamber 121 toward the fluid chamber 16, on the valve member 35 is limited. Therefore, the force, which is applied by the flow of fuel against the valve member 35 in the valve closing direction, is alleviated.

In the metering stroke, the valve member 35 is held in the state where the valve member 35 is lifted away from the valve seat 34 and is engaged with the stepped surface 501. Thereby, the low pressure fuel, which is discharged from the pressurizing chamber 121 due to the upward movement of the plunger 13, is returned to the fluid chamber 16 by flowing in the opposite direction that is opposite from the direction in the case of drawing fuel from the fluid chamber 16 to the pressurizing chamber 121, i.e., by flowing through the intake passage 112, the passage 102, the annular fuel passage 101, the passage 151 and the guide passage 111 in this order.

When the coil 71 is energized in the middle of the metering stroke, a magnetic field is generated by the coil 71 to form a magnetic circuit in the stator core 72, the flange 75 and the movable core 73. In this way, the magnetic attractive force is generated between the stator core 72 and the movable core 73, which have been spaced from each other before the energization of the coil 71. When the magnetic attractive force, which is generated between the stator core 72 and the movable core 73, is increased beyond the urging force of the spring 22, the movable core 73 is moved toward the stator core 72. Thereby, the needle 38, which is integrated with the movable core 73, is also moved toward the stator core 72. When the needle 38 is moved toward the stator core 72, the valve member 35 and the needle 38 are spaced from each other. Therefore, the valve member 35 does not receive the force from the needle 38. Thus, the valve member 35 is moved toward the valve seat 34 by the urging force of the spring 21 and the force applied to the valve member 35 in the valve closing direction by the flow of the low pressure fuel discharged from the pressurizing chamber 121 toward the fluid chamber 16. In this way, the valve member 35 is seated against the valve seat 34.

When the valve member 35 is moved toward and is seated against the valve seat 34, the valve member 35 is placed in the valve closed state. Thereby, the flow of the fuel through the fuel passage 100 is blocked. In this way, the metering stroke for discharging the low pressure fuel from the pressurizing chamber 121 to the fluid chamber 16 is terminated. At the time of upwardly moving the plunger 13, the communication between the pressurizing chamber 121 and the fluid chamber 16 is closed, and thereby the quantity of low pressure fuel, which is returned from the pressurizing chamber 121 to the fluid chamber 16, is adjusted. Therefore, the quantity of fuel, which is pressurized in the pressurizing chamber 121, is determined.

Next, a pressurizing stroke will be described. In the closed state where the communication between the pressurizing chamber 121 and the fluid chamber 16 is closed, when the plunger 13 is further upwardly moved, the pressure of the fuel in the pressurizing chamber 121 is further increased. When the pressure of the fuel in the pressurizing chamber 121 becomes equal to or larger than a predetermined pressure, the check valve 92 is lifted away from the valve seat 95 against the urging force of the spring 94 of the delivery valve arrangement 90 and the force applied to the check valve 92 from the fuel on the downstream side of the valve seat 95. In this way, the delivery vale arrangement 90 is opened. Thereby, the fuel, which is pressurized in the pressurizing chamber 121, is discharged from the high pressure pump 10 through the delivery passage 114. The fuel, which is discharged from the high pressure pump 10, is supplied to and accumulated in a delivery pipe (not shown), from which the high pressure fuel is supplied to the injectors.

When the plunger 13 reaches the top dead center, the energization of the coil 71 is stopped. Thereby, the valve member 35 is lifted away from the valve seat 34 once again. At this time, the plunger 13 is downwardly moved in FIG. 1 once again, so that the fuel in the pressurizing chamber 121 is reduced. In this way, the fuel is drawn into the pressurizing chamber 121 from the fluid chamber 16.

Here, it should be noted that the energization of the coil 71 may be stopped when the pressure of the fuel in the pressurizing chamber 121 is increased to the predetermined value upon the closing the valve member 35. When the pressure of the fuel in the pressurizing chamber 121 becomes large, the force, which is applied from the fuel in the pressurizing chamber 121 to the valve member 35 toward the valve seat 34, becomes larger than the force, which is applied to the valve member 35 in the direction away from the valve seat 34. Therefore, even when the energization of the coil 71 is stopped, the valve member 35 is held in the seated state where the valve member 35 is seated against the valve seat 34 by the force of the fuel applied from the pressurizing chamber 121. As discussed above, when the energization of the coil 71 is stopped at the predetermined timing, it is possible to reduce the electric power consumption of the electromagnetic drive device 70.

When the intake stroke, the metering stroke and the pressurizing stroke are repeated, the fuel, which is drawn into the high pressure pump 10, is pressurized and is discharged from the high pressure pump 10. The quantity of the fuel, which is discharged from the high pressure pump 10, is adjusted by controlling the timing of the energization of the coil 71 of the electromagnetic drive device 70.

Figure 2:
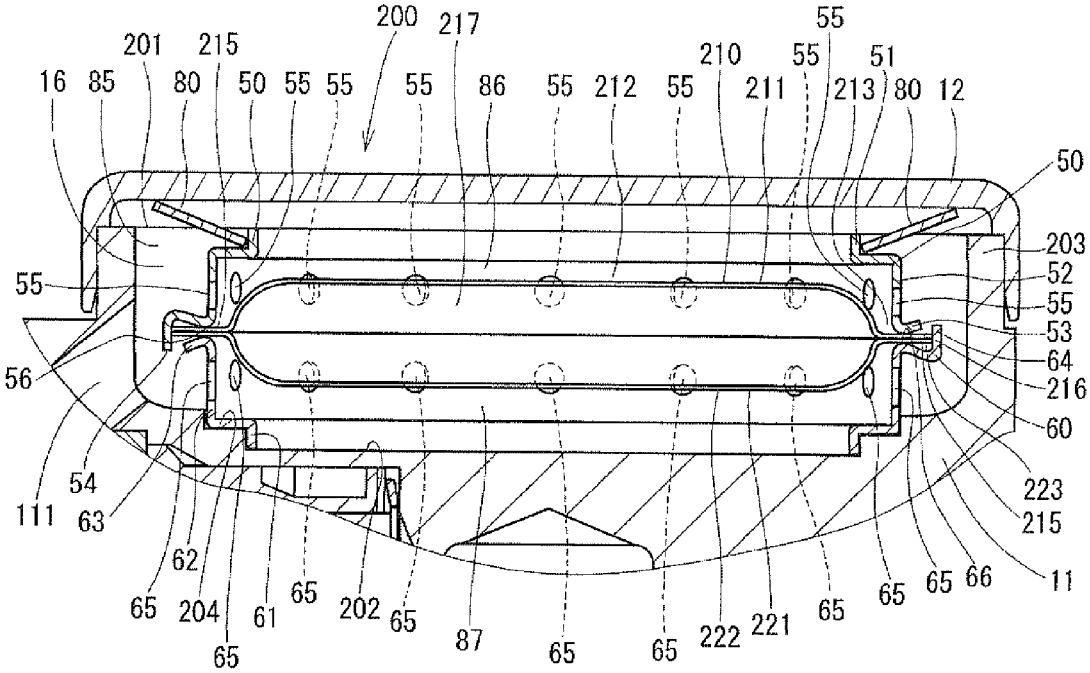
FIG. 2 is a partial enlarged cross-sectional view of the high pressure pump of the first embodiment.

In the present embodiment, the damper device 200 is provided to reduce the pressure pulsation at the fluid chamber 16, which is communicated with the guide passage 111. Now, the damper device 200 will be described in detail with reference to FIG. 2. FIG. 2 is an enlarged partial view showing the damper device 200 of FIG. 1.

The damper device 200 includes the housing 11, the cover member 12, the damper member 210, the first-side support member 50 and the second-side support member 60.

The housing 11 includes a tubular portion 203 that is configured into a tubular form and has an opening 201 at one end of the tubular portion 203, which is opposite from the plunger 13 placed in the pressurizing chamber 121 (see FIG. 1). The tubular portion 203 forms the fluid chamber 16 at the location radially inward of the tubular portion 203. The fluid chamber 16 is generally coaxial with the plunger 13. At the tubular portion 203, a stepped portion (blind hole, i.e., recess) 204 is formed in a bottom portion (serving as a bottom portion of the opening 201 of the housing 11) 202.

The cover member 12 is configured into a cup-shaped body (i.e., a body having a planar bottom and a cylindrical peripheral wall projecting from an outer peripheral edge part of the bottom) and is made of, for example, stainless steel. One end part of the cover member 12 (specifically, one end part of the cylindrical peripheral wall of the cover member 12, which is opposite from the bottom of the cover member 12) is joined to an outer peripheral wall of the tubular portion 203 of the housing 11 by, for example, welding to close the opening 201 of the fluid chamber 16.

The damper member 210 includes a first-side diaphragm 211 and a second-side diaphragm 221. The first-side diaphragm 211 and the second-side diaphragm 221 are produced by configuring a metal plate (made of metal, such as stainless steel, which exhibits a high yield strength and a high fatigue strength) into a dish form through press working of the metal plate. The first-side diaphragm 211 includes a first-side damper portion (first-side damping portion having an outwardly concaved surface) 212 and a first-side outer peripheral portion 213. The first-side damper portion 212 is resiliently deformable. The first-side outer peripheral portion 213 is provided along an outer peripheral edge part of the first-side damper portion 212. The first-side damper portion 212 and the first-side outer peripheral portion 213 are formed integrally as a single continuous element.

Similar to the first-side diaphragm 211, the second-side diaphragm 221 includes a second-side damper portion (second-side damping portion having an outwardly concaved surface) 222 and a second-side outer peripheral portion 223, which are similar to the first-side damper portion 212 and the first-side outer peripheral portion 213 and are formed integrally as a single continuous element. In the present embodiment, the first-side diaphragm 211 is placed on the cover member 12 side, and the second-side diaphragm 221 is placed on the bottom portion 202 side.

An outer peripheral edge part of the first-side outer peripheral portion 213 and an outer peripheral edge part of the second-side outer peripheral portion 223 are welded together along the entire circumference thereof and thereby form a weld 216 (serving as a sealing position or section). Thereby, the first-side diaphragm 211 and the second-side diaphragm 221 are fluid tightly (air tightly and liquid tightly) sealed together to form a damper chamber 217 between the first-side damper portion 212 and the second-side damper portion 222. The first-side outer peripheral portion 213 and the second-side outer peripheral portion 223, which are joined together at the weld 216, form an outer peripheral portion 215 of the damper member 210.

The damper chamber 217 is filled with a gas (such as helium, argon or a mixture of helium and argon) at a predetermined pressure (e.g., 300 kPa). The first-side damper portion 212 and the second-side damper portion 222 are resiliently deformable depending on a change in the pressure of the fluid chamber 16. When the first-side damper portion 212 and the second-side damper portion 222 are resiliently deformed, the volume of the damper chamber 217 is changed to reduce the pressure pulsation at the fluid chamber 16.

A spring constant of the damper member 210 is set depending on the required durability or any other required performance of the damper member 210 by appropriately selecting a wall thickness and a material of the first and second-side diaphragms 211, 222 and the pressure of the fluid filled in the damper chamber 217. A frequency of the pressure pulsation to be reduced by the damper member 210 is determined according to this spring constant. Furthermore, the pressure pulsation reducing performance of the damper member 210 varies depending on the volume of the damper chamber 217.

The first-side support member 50 and the second-side support member 60 are configured into a generally cylindrical form. The first-side support member 50 and the second-side support member 60 clamp the outer peripheral portion 215 of the damper member 210 therebetween to support the damper member 210 in the fluid chamber 16.

The first-side support member 50 is placed between the cover member 12 and the damper member 210 and includes a first-side small diameter portion (serving as an annular support portion) 51, a first-side tubular portion 52, a first-side flange portion 53 and first-side claw portions 54. The first-side tubular portion 52 is configured into a tubular form and includes first-side communication holes 55, which are formed as through holes that communicate between an outer wall surface and an inner wall surface of the first-side tubular portion 52. The first-side small diameter portion 51 extends from a cover member 12 side end part of the first-side tubular portion 52 in a direction, which is generally perpendicular to the axis of the first-side support member 50. The first-side small diameter portion 51 is fitted to one end of the Belleville spring 80, which is configured into an annular form. The first-side flange portion 53 radially outwardly extends from a damper member 210 side end part of the first-side tubular portion 52 and is configured into an annular form. Furthermore, the first-side flange portion 53 is bent to tilt toward the first-side small diameter portion 51 of the first-side support member 50. The first-side claw portions 54 extend radially outwardly from an outer peripheral edge part of the first-side flange portion 53 and is then bent in a direction, which is opposite from the first-side small diameter portion 51, at tips thereof. The first-side claw portions 54 are provided at multiple locations, respectively, along the first-side flange portion 53. In the present embodiment, the first-side support member 50 and the Belleville spring 80 serve as a first-side support member of the present invention, and the first-side claw portions 54 serve as first-side projections of the present invention.

The second-side support member 60 is provided between the bottom portion 202 of the housing 11 and the damper member 210 and includes a second-side small diameter portion 61, a second-side tubular portion 62, a second-side flange portion 63 and second-side claw portions 64. The second-side tubular portion 62 is configured into a tubular form and includes second-side communication holes 65, which are formed as through holes that communicate between an outer wall surface and an inner wall surface of the second-side tubular portion 62. The second-side small diameter portion 61 extends from a cover member 12 side end part of the second-side tubular portion 62 in a direction, which is generally perpendicular to the axis of the second-side support member 60. The second-side small diameter portion 61 is fitted to the stepped portion 204, which is formed at the bottom portion 202 of the housing 11. The second-side small diameter portion 61 serves as an anchoring portion of the present invention. The second-side flange portion 63 radially outwardly extends from a damper member 210 side end part of the second-side tubular portion 62 and is configured into an annular form. Furthermore, the second-side flange portion 63 is bent to tilt toward the second-side small diameter portion 61 of the second-side support member 60. The second-side claw portions 64 extend radially outwardly from an outer peripheral edge part of the second-side flange portion 63 and is then bent in a direction, which is opposite from the second-side small diameter portion 61, at tips thereof. The second-side claw portions 64 are provided at multiple locations, respectively, along the second-side flange portion 63. The second-side claw portions 64 serve as second-side projections of the present invention.

The first-side claw portions 54 and the second-side claw portions 64 securely hold an outer peripheral edge part of the outer peripheral portion 215 of the damper member 210. Therefore, the radial relative movement of the damper member 210, the first-side support member 50 and the second-side support member 60 relative to each other is limited.

The first-side support member 50 and the first-side outer peripheral portion 213 of the damper member 210 are continuously engaged with each other along the entire circumference thereof at a first-side engaging portion 56, which is located radially inward of the weld 216. The second-side support member 60 and the second-side outer peripheral portion 223 of the damper member 210 are continuously engaged with each other along the entire circumference thereof at a second-side engaging portion 66, which is located radially inward of the weld 216. The first-side engaging portion 56 and the second-side engaging portion 66 are located generally along a common imaginary circle.

An outer fluid chamber 85 is formed between the housing 11 and the first and second-side support members 50, 60 and is communicated with the guide passage 111. The outer fluid chamber 85 is located radially outward of the first and second-side support members 50, 60 and circumferentially surrounds the first and second-side support members 50, 60.

The first-side inner fluid chamber 86 is formed at a location radially inward of the first-side support member 50. The first-side inner fluid chamber 86 is communicated with the outer fluid chamber 85 through the first-side communication holes 55. A second-side inner fluid chamber 87 is formed at a location radially inward of the second-side support member 60. The second-side inner fluid chamber 87 is communicated with the outer fluid chamber 85 through the second-side communication holes 65. Specifically, the first-side inner fluid chamber 86 and the second-side inner fluid chamber 87 are communicated with each other through the outer fluid chamber 85. The outer fluid chamber 85, the first-side inner fluid chamber 86 and the second-side inner fluid chamber 87 form the fluid chamber 16.

Now, an installation process of the damper device 200 will be described in detail with reference to FIG. 2.

The second-side support member 60 is installed into the tubular portion 203 through the opening 201 of the housing 11 such that the second-side small diameter portion 61 of the second-side support member 60 is fitted to the stepped portion 204. In this way, the position of the second-side support member 60 in the housing 11 is set. Next, the damper member 210 is installed such that the second-side outer peripheral portion 223 of the damper member 210 is engaged with the second-side engaging portion 66 of the second-side support member 60. At this time, the radial position of the damper member 210 is set by the second-side claw portions 64, which are engaged with the outer peripheral edge part of the damper member 210. Next, the first-side support member 50 is installed such that the first-side engaging portion 56 of the first-side support member 50 is engaged with the first-side outer peripheral portion 213 of the damper member 210. At this time, the first-side claw portions 54 are circumferentially displaced from the second-side claw portions 64, so that the first-side claw portions 54 do not overlap with the second-side claw portions 64 in the axial direction. Furthermore, the Belleville spring 80 is fitted to the first-side small diameter portion 51 of the first-side support member 50. Then, the cover member 12 is fitted to and is fixed to the outer peripheral wall of the tubular portion 203 of the housing 11 by, for example, welding while applying a load to an end part (outer peripheral edge part) of the Belleville spring 80, which is opposite from the first-side support member 50. At this time, the Belleville spring 80 is urged by the cover member 12 and is thereby resiliently deformed. The first-side support member 50 and the second-side support member 60 are urged by the cover member 12 through the Belleville spring 80, so that the outer peripheral portion 215 of the damper member 210 is clamped between the first-side support member 50 and the second-side support member 60. In this way, the damper member 210 is supported between the housing 11 and the cover member 12 through the first-side support member 50 and the second-side support member 60.

As discussed above in detail, the high pressure pump 10 of the present embodiment includes the damper device 200. The first-side damper portion 212 and the second-side damper portion 222 are resiliently deformable according of the change in the pressure at the fluid chamber 16. When the first-side damper portion 212 and the second-side damper portion 222 are resiliently deformed, the volume of the damper chamber 217 defined in the damper member 210 is changed to reduce the pressure pulsation at the fluid chamber 16. Thereby, it is possible to limit the transmission of the pressure pulsation of the fuel to the low pressure fuel conduit, which is communicated with the fluid chamber 16.

In the present embodiment, the Belleville spring 80 is provided and is resiliently deformable between the housing 11 and the cover member 12. The first-side support member 50 and the second-side support member 60 are urged by the cover member 12 thorough the Belleville spring 80 and thereby clamp the outer peripheral portion 215 of the damper member 210 therebetween, so that the damper member 210 is supported between the housing 11 and the cover member 12. With the above-described construction, the number of the components can be reduced, and the pulsation of the pressure can be limited with the simple structure. Furthermore, the damper member 210 is supported by the generally cylindrical first and second-side support members 50, 60 in the fluid chamber 16. Therefore, the remaining space around the damper member 210 can be maximized. Particularly, the sufficient radial space is provided around the damper member 210, so that the fuel can be thoroughly supplied to the outer fluid chamber 85, the first-side inner fluid chamber 86 and the second-side inner fluid chamber 87, and thereby it is possible to achieve the high damping performance for damping the pressure pulsation.

In the present embodiment, the second-side support member 60, the damper member 210, the first-side support member 50 and the Belleville spring 80 are installed to the housing 11 through the opening 201 in this order and are urged by the cover member 12, which is in turn fixed to the housing 11 by, for example, the welding. Therefore, the easy assembling is made possible. In this way, the number of assembling steps can be reduced.

Furthermore, according to the present embodiment, due to the presence of the Belleville spring 80, the first-side support member 50 and the second-side support member 60 are not required to have the resiliency, and thereby it is possible to limit the pulsation of the pressure with the relatively simple structure.

The first-side engaging portion 56 and the second-side engaging portion 66 are placed radially outward of the weld 216. In the case where the internal pressure of the damper member 210 is higher than the pressure of fuel in the fluid chamber 16 to cause bulging of the damper member 210, it is possible to limit the load applied to the weld 216 since the outer peripheral portion 215 of the damper member 210 is clamped by the first-side engaging portion 56 and the second-side engaging portion 66, which are located radially inward of the weld 216. In this way, it is possible to limit a damage of the damper member 210.

In the present embodiment, the bottom portion 202, which is opposed to the cover member 12, has the stepped portion 204. Furthermore, the second-side support member 60 is anchored to, i.e., is securely held with the stepped portion 204 by fitting the second-side small diameter portion 61 of the second-side support member 60 to the stepped portion 204. In this way, the second-side support member 60 can be appropriately positioned relative to the housing 11, and thereby the damper member 210, the first-side support member 50 and the Belleville spring 80 can be appropriately positioned relative to the housing 11.

The first-side support member 50 includes the first-side claw portions 54, which are located radially outward of the outer peripheral portion 215 and project toward the second-side support member 60. The second-side support member 60 includes the second-side claw portions 64, which are located radially outward of the outer peripheral portion 215 and project toward the first-side support member 50. At the time of installation, the first-side claw portions 54 and the second-side claw portions 64 are circumferentially displaced from each other. In this way, it is possible to limit the occurrence of radial displacement of the first-side support member 50 and the second-side support member 60, and it is also possible to limit the occurrence of radial displacement of the damper member 210, which is clamped between the first-side support member 50 and the second-side support member 60.

Furthermore, the first-side support member 50 has the first-side communication holes 55. Also, the second-side support member 60 has the second-side communication holes 65. In this way, the fluid resistance is reduced, so that the fuel can be more easily supplied to the outer fluid chamber 85, the first-side inner fluid chamber 86 and the second-side inner fluid chamber 87, and thereby it is possible to achieve the high damping performance for damping the pressure pulsation.

Second Embodiment

Figure 3:
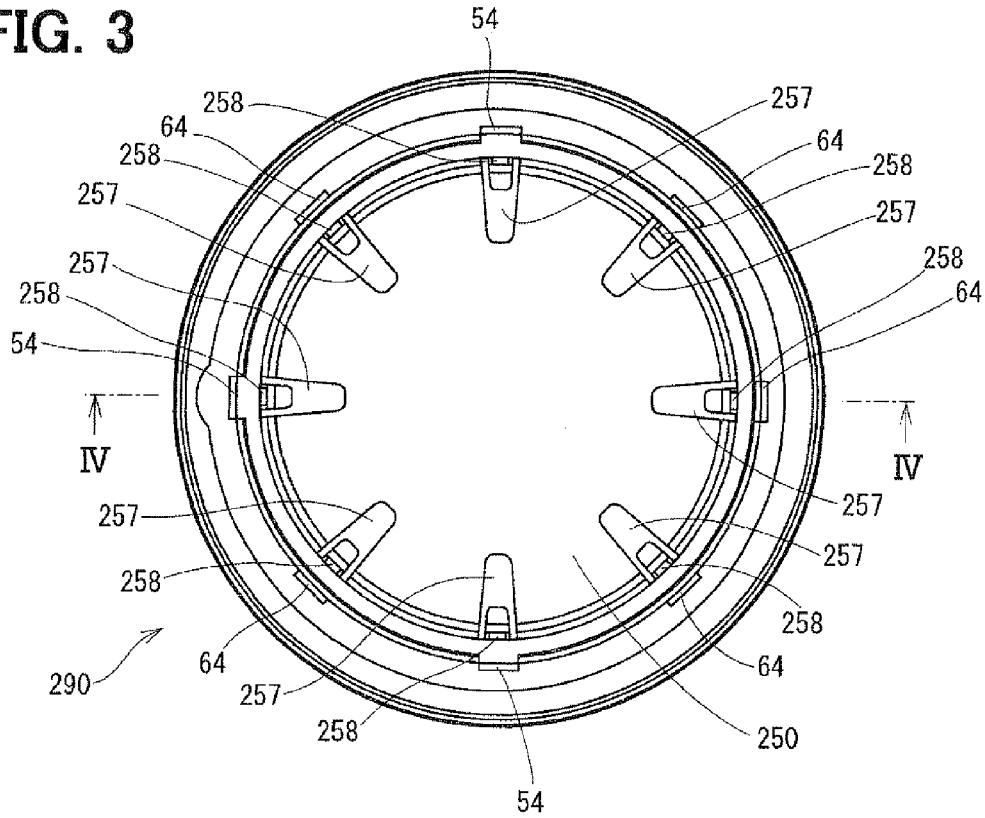
FIG. 3 is a plan view taken in a direction of an arrow III in FIG. 1.
Figure 4:
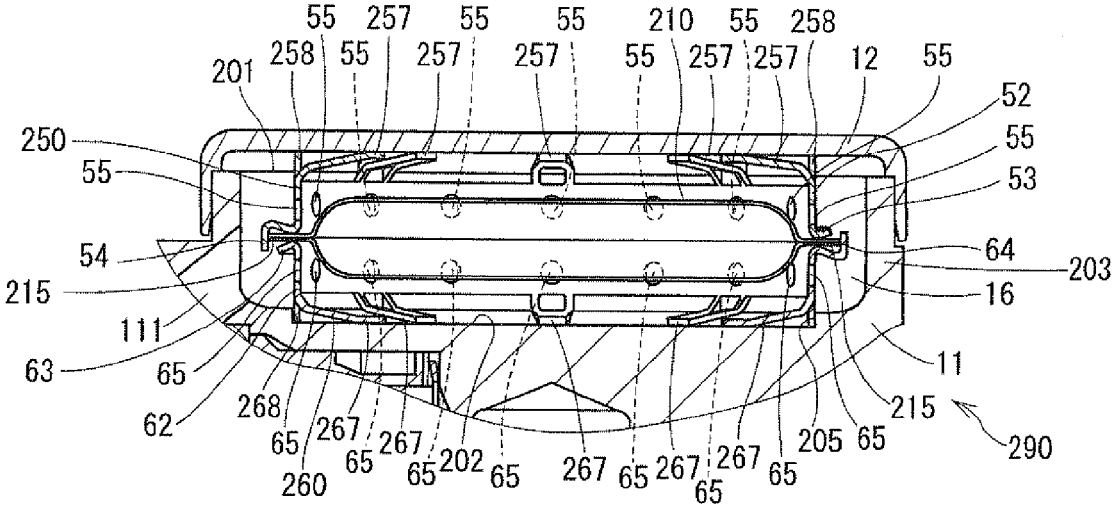
FIG. 4 is a partial cross-sectional view taken along line IV-IV in FIG. 3.

A damper device of a high pressure pump according to a second embodiment of the present invention will be described with reference to FIGS. 3 and 4. In the following embodiments, similar components will be indicated by the same reference numerals and will not be described redundantly for the sake of simplicity. FIG. 3 is a plan view taken in a direction of an arrow III in FIG. 1 after removal of the cover member. FIG. 4 is a partial cross-sectional view taken along line IV-IV in FIG. 3, showing the damper device of the high pressure pump in an enlarged scale.

In the damper device 290 of the second embodiment, a first-side support member 250 includes first-side leaf spring portions 257, which are formed integrally in the first-side support member 250. Furthermore, the first-side support member 250 is resiliently deformably formed. An inner part (circumferentially inner part) of each first-side leaf spring portion 257 is cut into a U-shape form and is bent to form a bent part, which is formed as a first-side leg portion 258. The first-side leg portion 258 extends generally perpendicularly from the rest of the first-side leaf spring portion 257 and is engaged with the cover member 12.

Similar to the first-side support member 250, a second-side support member 260 includes second-side leaf spring portions 267 formed integrally in the second-side support member 260 and is resiliently deformably formed. An inner part (circumferentially inner part) of each second-side leaf spring portion 267 is cut into a U-shape form and is bent to form a bent part, which is formed as a second-side leg portion 268. The second-side leg portion 268 extends generally perpendicularly from the rest of the second-side leaf spring portion 267 and is engaged with a stepped portion (blind hole, i.e., recess) 205, which is formed in the bottom portion 202 of the housing 11. In the present embodiment, the second-side leg portions 268 serve as anchoring portions of the present invention.

As discussed above, in the present embodiment, the first-side support member 250 and the second-side support member 260 are resiliently deformably formed, so that advantages, which are similar to those of the first embodiment, can be achieved. Furthermore, in the present embodiment, the first-side leaf spring portions 257 are formed integrally with the first-side support member 250. The second-side leaf spring portions 267 are formed integrally with the second-side support member 260. Therefore, according to the present embodiment, the number of the components and the number of the assembling steps can be reduced in comparison to the first embodiment.

Third Embodiment

Figure 5:
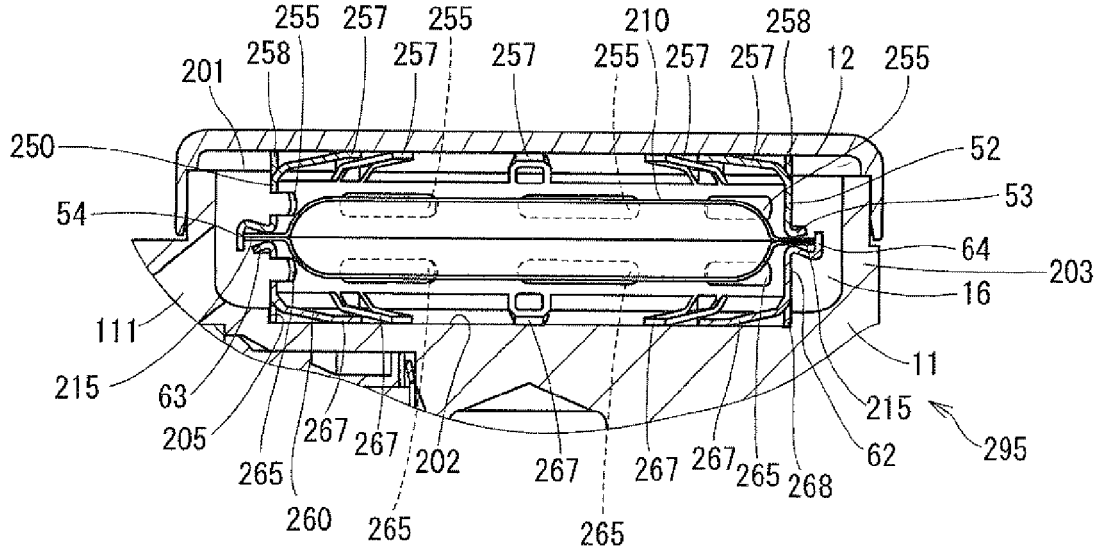
FIG. 5 is a partial cross-sectional view showing a damper device according to a third embodiment of the present invention.

A damper device of a high pressure pump according to a third embodiment of the present invention will be described with reference to FIG. 5.

The third embodiment is a modification of the second embodiment. With reference to FIG. 5, in place of the first-side communication holes 55 and the second-side communication holes 65 of the second embodiment shown in FIGS. 3 and 4, the damper device 295 of the third embodiment includes first-side communication holes 255 in the first-side support member 250 and second-side communication holes 265 in the second-side support member 260. The first-side communication holes 255 and the second-side communication holes 265 are formed as elongated holes, which are elongated in the circumferential direction. Alternatively, the first-side communication holes 255 and the second-side communication holes 265 may be formed as elongated holes, which are elongated in an oblique direction that is oblique to the circumferential direction or which are elongated in the axial direction.

Even with this construction, it is possible to achieve advantages, which are similar to those discussed in the second embodiment. Furthermore, since the first-side communication holes 255 and the second-side communication holes 265 are formed as elongated holes, a flow passage cross-sectional area of each of the first-side communication holes 255 and the second-side communication holes 265 is increased in comparison to the circular hole. Therefore, it is possible to further reduce the fluid resistance. In this way, the fuel can be more easily supplied to the outer fluid chamber 85, the first-side inner fluid chamber 86 and the second-side inner fluid chamber 87, and thereby it is possible to achieve the high damping performance for damping the pressure pulsation. These elongated holes can be applied to any other one of the embodiments of the present invention. Furthermore, the shape of each of these elongated holes can be changed to any other appropriate shape as long as the sufficient flow passage cross sectional area can be provided.

Fourth Embodiment

Figure 6:
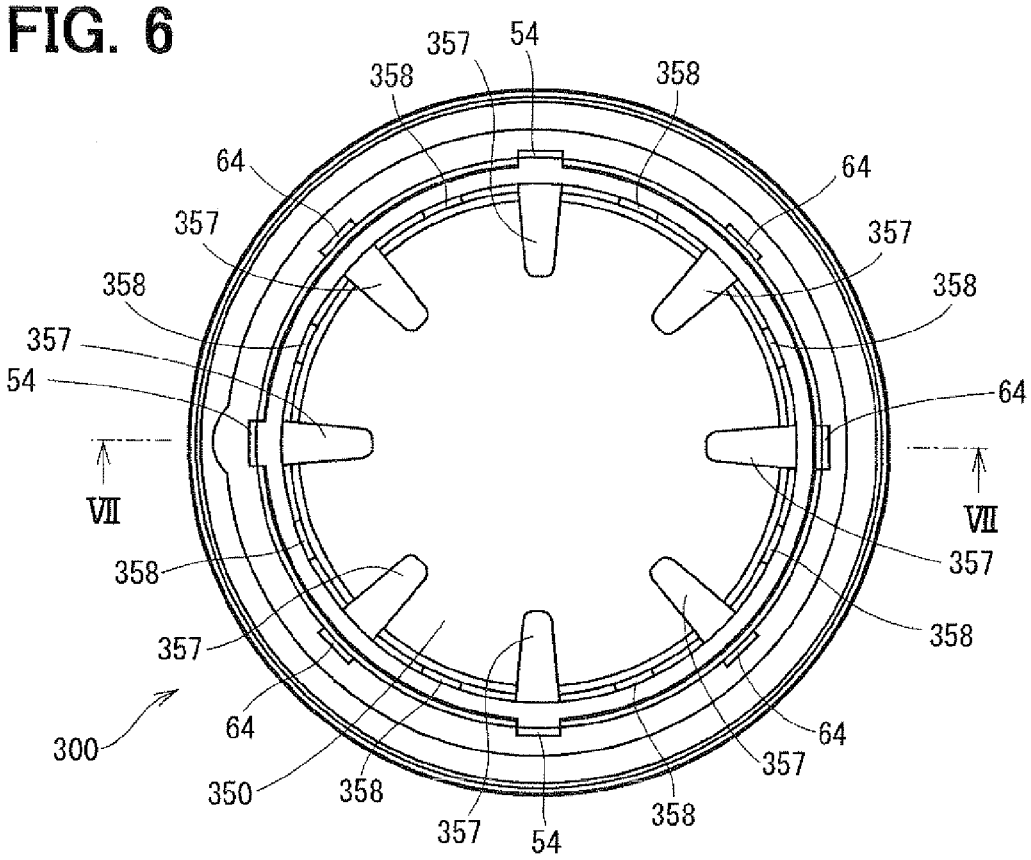
FIG. 6 is a plan view similar to FIG. 3, showing a damper device according to a fourth embodiment of the present invention.
Figure 7:
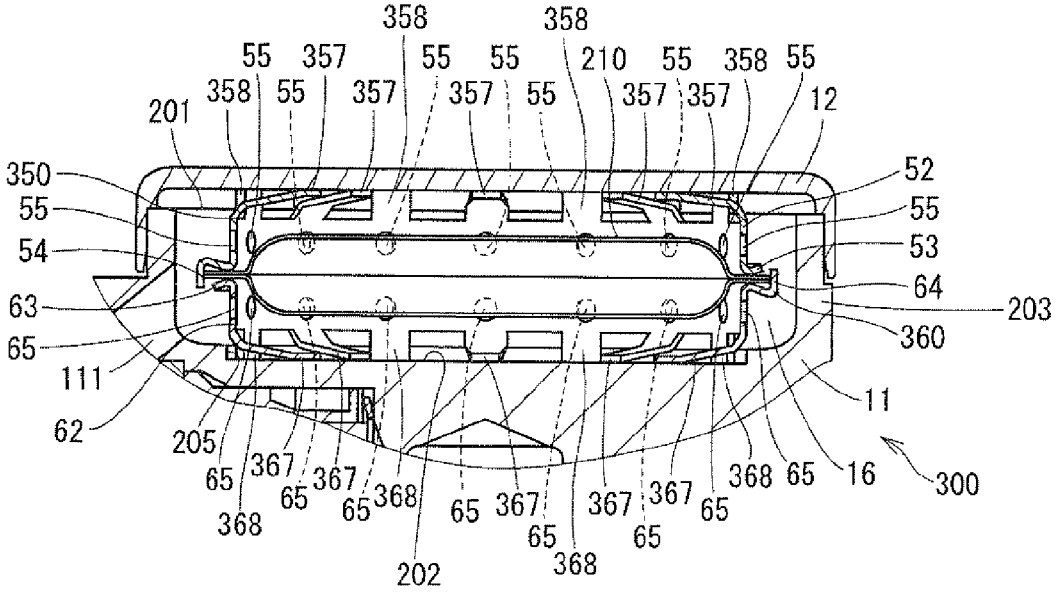
FIG. 7 is a partial cross-sectional view taken along line VII-VII in FIG. 6.
Figure 8:
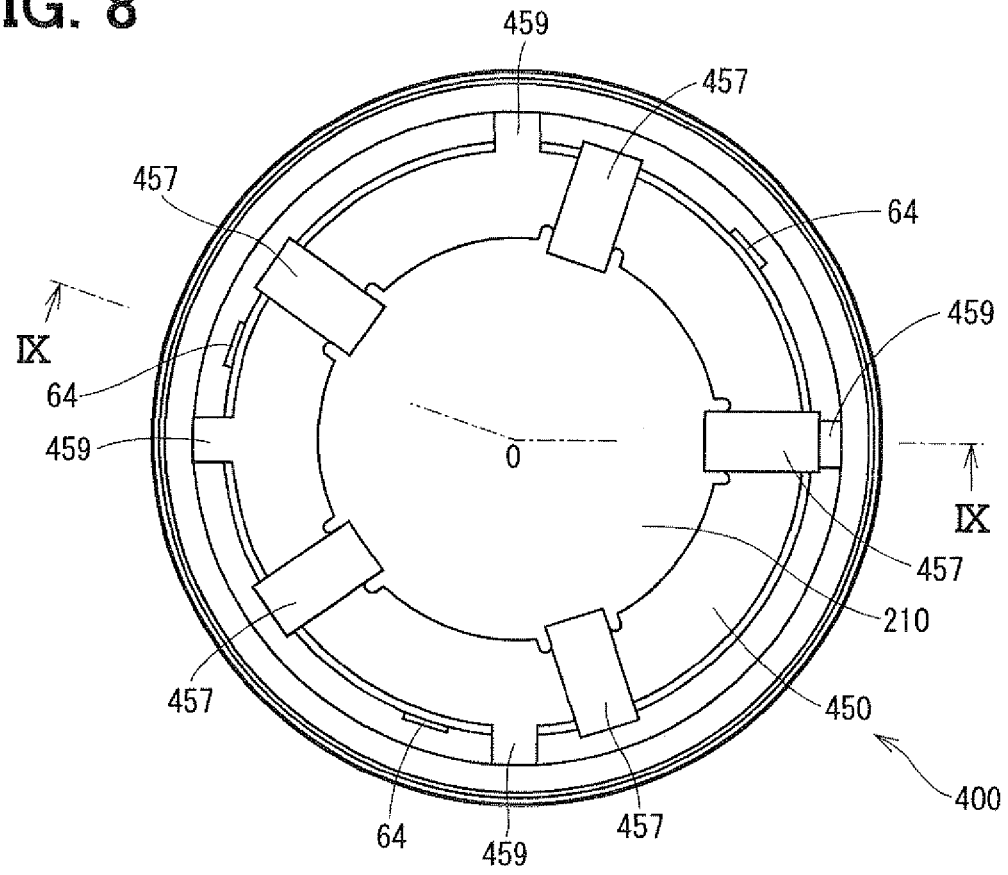
FIG. 8 is a plan view similar to FIG. 3, showing a damper device according to a fifth embodiment of the present invention.

A damper device of a high pressure pump according to a fourth embodiment of the present invention will be described with reference to FIGS. 6 and 7. FIG. 6 is a plan view similar to FIG. 3. FIG. 7 is a cross-sectional view taken along line VII-VII in FIG. 8, showing the damper device of the high pressure pump in an enlarged scale.

The fourth embodiment is a modification of the second embodiment. In place of the first-side leaf spring portions 257 and the first-side leg portions 258 of the second embodiment shown in FIGS. 3 and 4, the damper device 300 of the fourth embodiment includes first-side leaf spring portions 357 and first-side leg portions 358 in the first-side support member 350. Unlike the second embodiment, the first-side leaf spring portions 357 are circumferentially displaced from the first-side leg portions 358. Similarly, in place of the second-side leaf spring portions 267 and the second-side leg portions 268 of the second embodiment shown in FIGS. 3 and 4, the damper device 300 of the fourth embodiment includes second-side leaf spring portions 367 and second-side leg portions 368 in the second-side support member 360. The second-side leaf spring portions 367 are circumferentially displaced from the second-side leg portions 368.

Even with this construction, it is possible to achieve advantages, which are similar to those discussed in the second embodiment.

Fifth Embodiment

Figure 9:
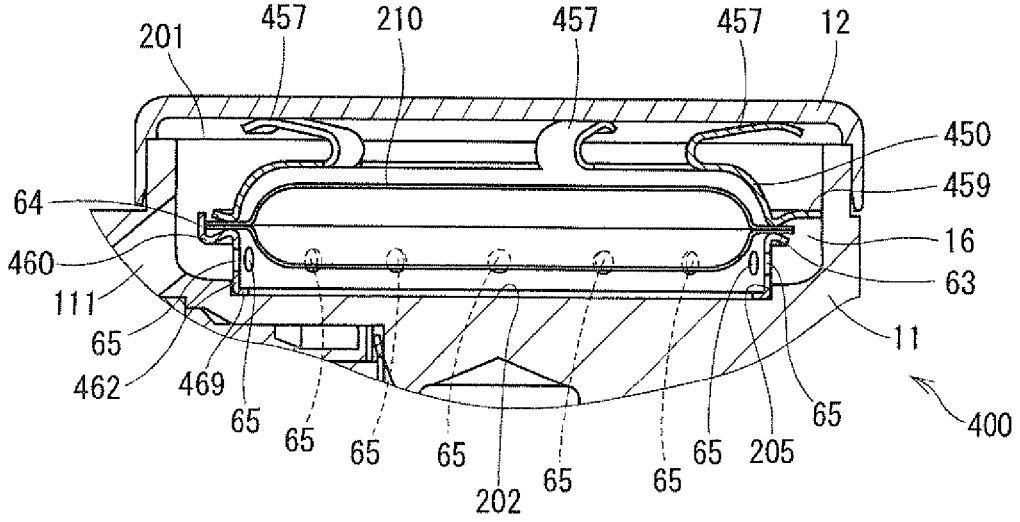
FIG. 9 is a partial cross-sectional view taken along line IX-0-IX in FIG. 8.

A damper device of a high pressure pump according to a fifth embodiment of the present invention will be described with reference to FIGS. 8 and 9. FIG. 8 is a plan view similar to FIG. 3. FIG. 9 is a cross-sectional view taken along line IX-0-IX in FIG. 8, showing the damper device of the high pressure pump in an enlarged scale.

In place of the first-side support member 50 of the first embodiment shown in FIGS. 1 and 2, a first-side support member 450 is provided in the damper device 400 of the fifth embodiment. A cover member 12 side end part of the first-side support member 450 is opened. First-side leaf spring portions 457 are provided to the cover member 12 side end part of the first-side support member 450. Each first-side leaf spring portion 457 is configured into a U-shape form and is resiliently deformable. Furthermore, extended portions 459 are formed at a damper member 210 side end part of the first-side support member 450 such that the extended portions 459 radially outwardly extend from the rest of the damper member 210 side end part of the first-side support member 450 and contact with the inner peripheral wall of the housing 11 in a direction generally perpendicular to the inner peripheral wall of the housing 11. The position of the first-side support member 450 is set by engaging the extended portions 459 to the inner peripheral wall of the housing 11.

An anchoring portion 469 is formed at a bottom portion 202 side end part of a second-side tubular portion 462 of a second-side support member 460 such that the anchoring portion 469 is bent from the rest of the bottom portion 202 side end part of second-side tubular portion 462 in a direction, which is generally perpendicular to the rest of the bottom portion 202 side end part of the second-side tubular portion 462. The anchoring portion 469 and the second-side tubular portion 462 are anchored to, i.e., are securely held with the stepped portion 205, which is formed in the bottom portion 202 of the housing 11, so that the position of the second-side support member 460 in the housing 11 is set. In the present embodiment, the second-side tubular portion 462 and the anchoring portion 469 serve as an anchoring portion(s) of the present invention.

Even with this construction, it is possible to achieve advantages, which are similar to those discussed in the second embodiment. Furthermore, in the present embodiment, the cover member 12 side end part of the first-side support member 450 is opened, so that it is not required to form additional through holes (e.g., through holes similar to the first-side communication holes 55 of the first embodiment) in the first-side support member 450, and it is possible to achieve the high damping performance for damping the pressure pulsation. Furthermore, since the second-side support member 460 has the simpler structure, the manufacturing of the second-side support member 460 is eased.

Sixth Embodiment

Figure 10:
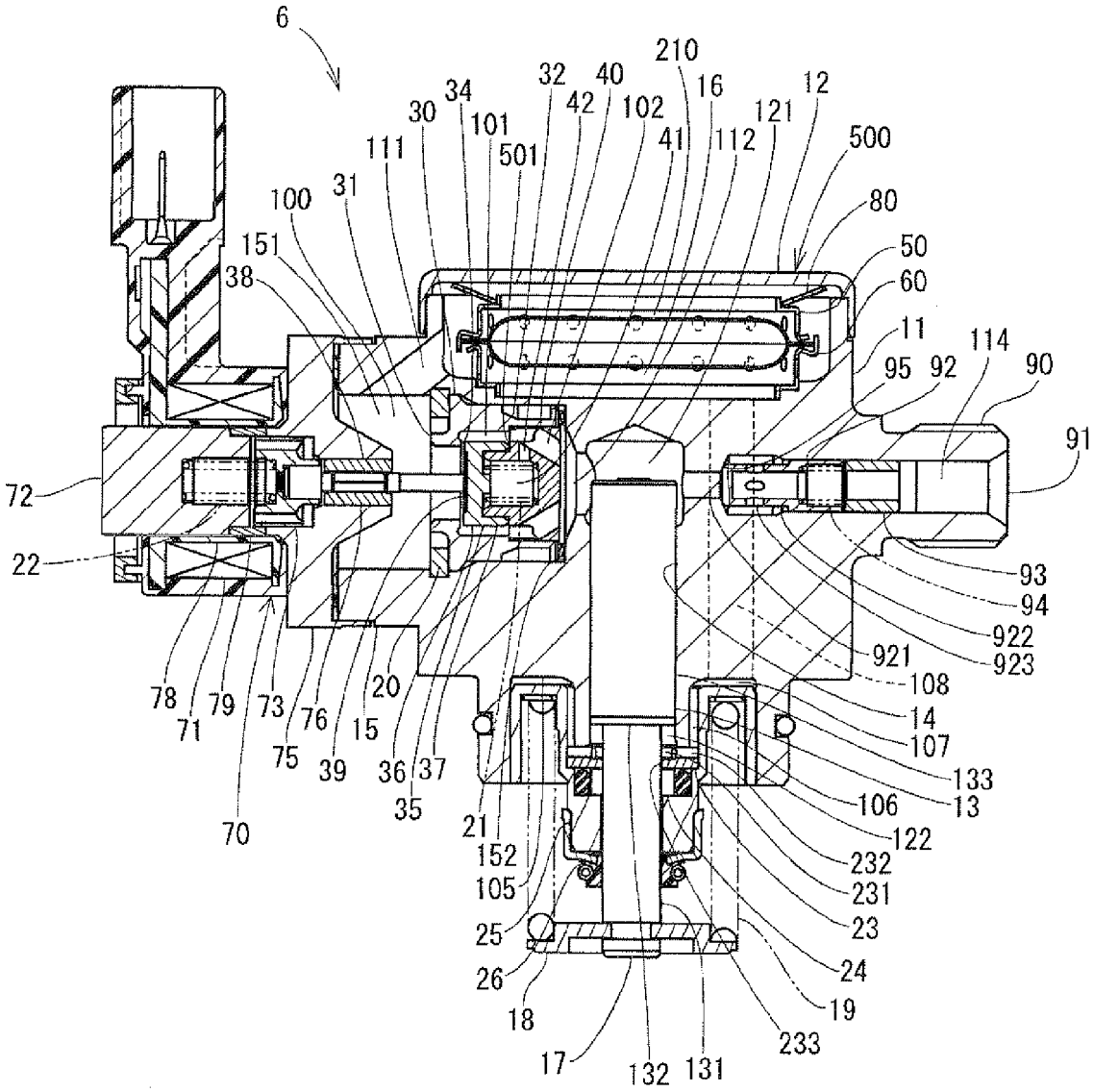
FIG. 10 is a cross-sectional view of a high pressure pump according to a sixth embodiment of the present invention.
Figure 11:
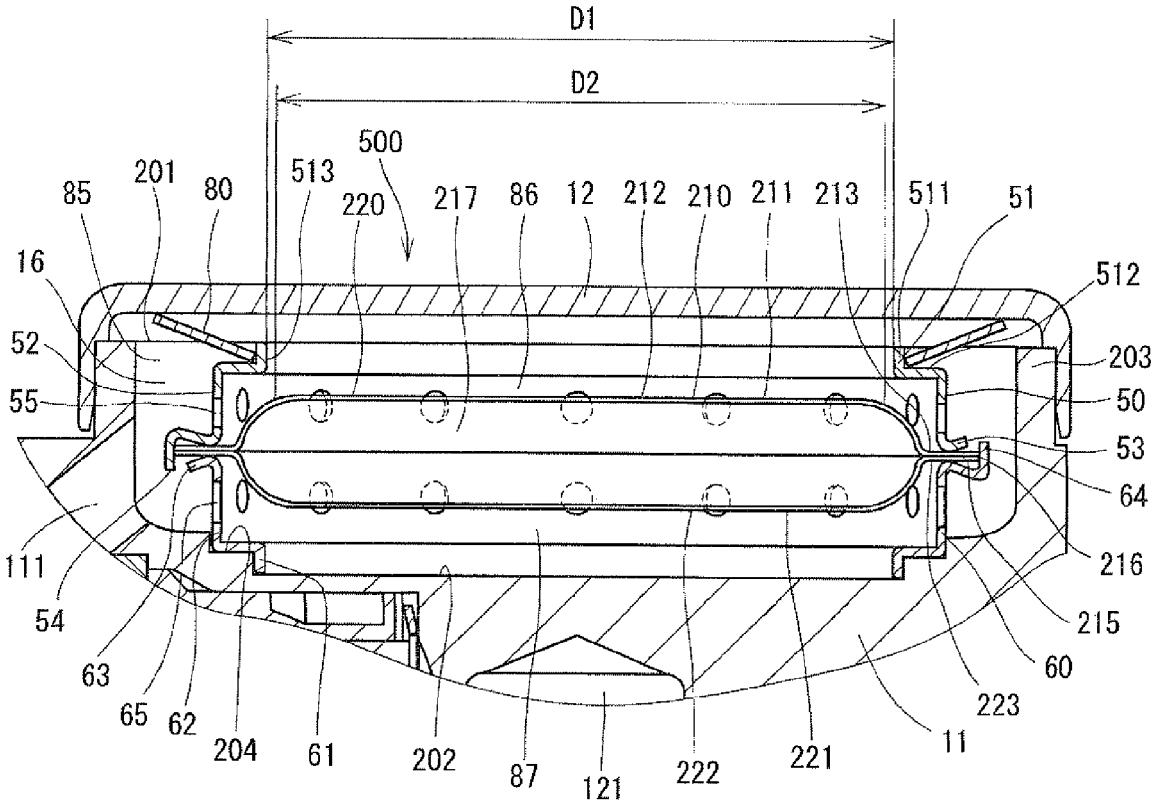
FIG. 11 is a partial enlarged cross-sectional view of the high pressure pump according to the sixth embodiment.
Figure 12:
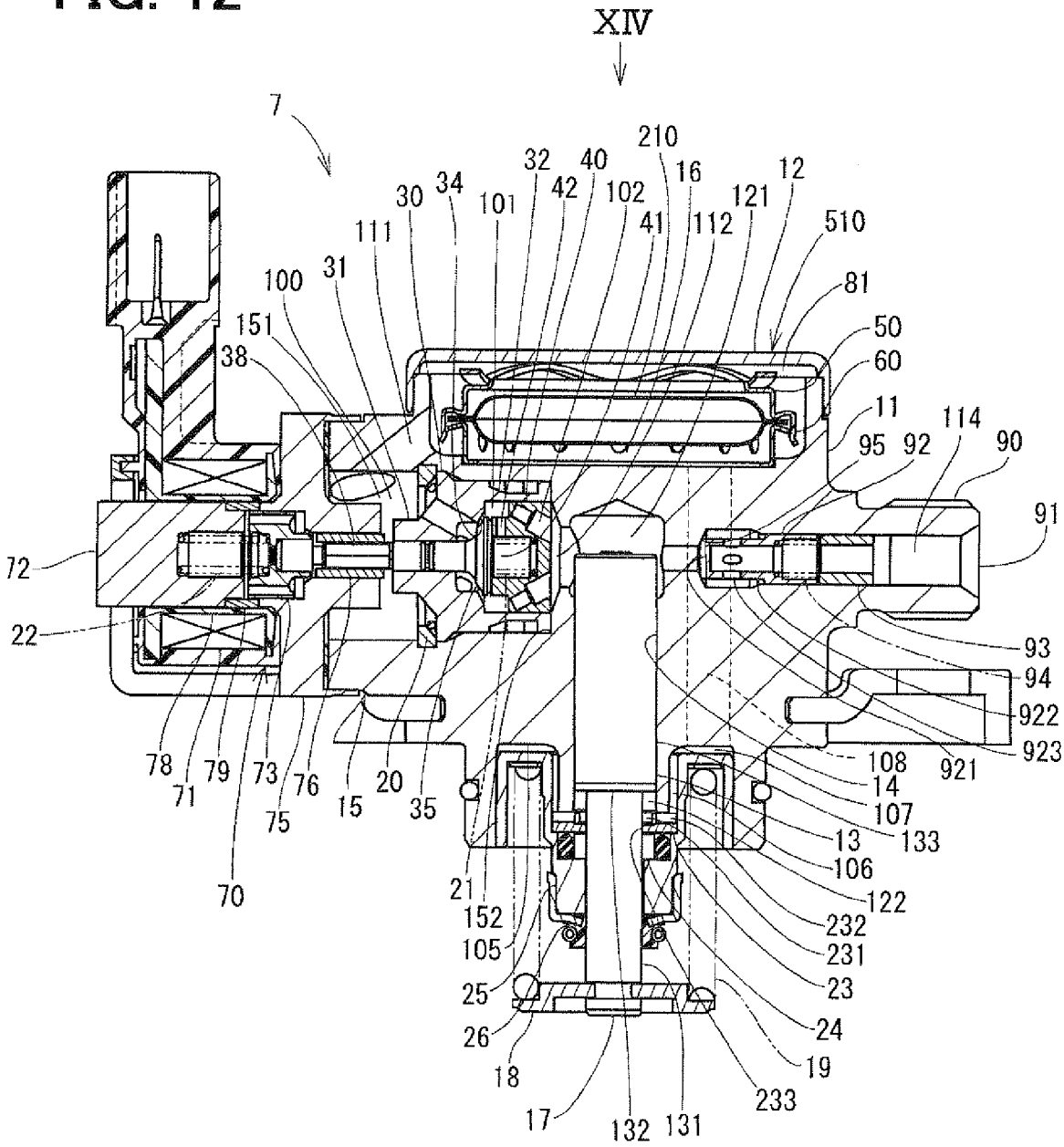
FIG. 12 is a cross-sectional view of a high pressure pump according to a seventh embodiment of the present invention.
Figure 13:
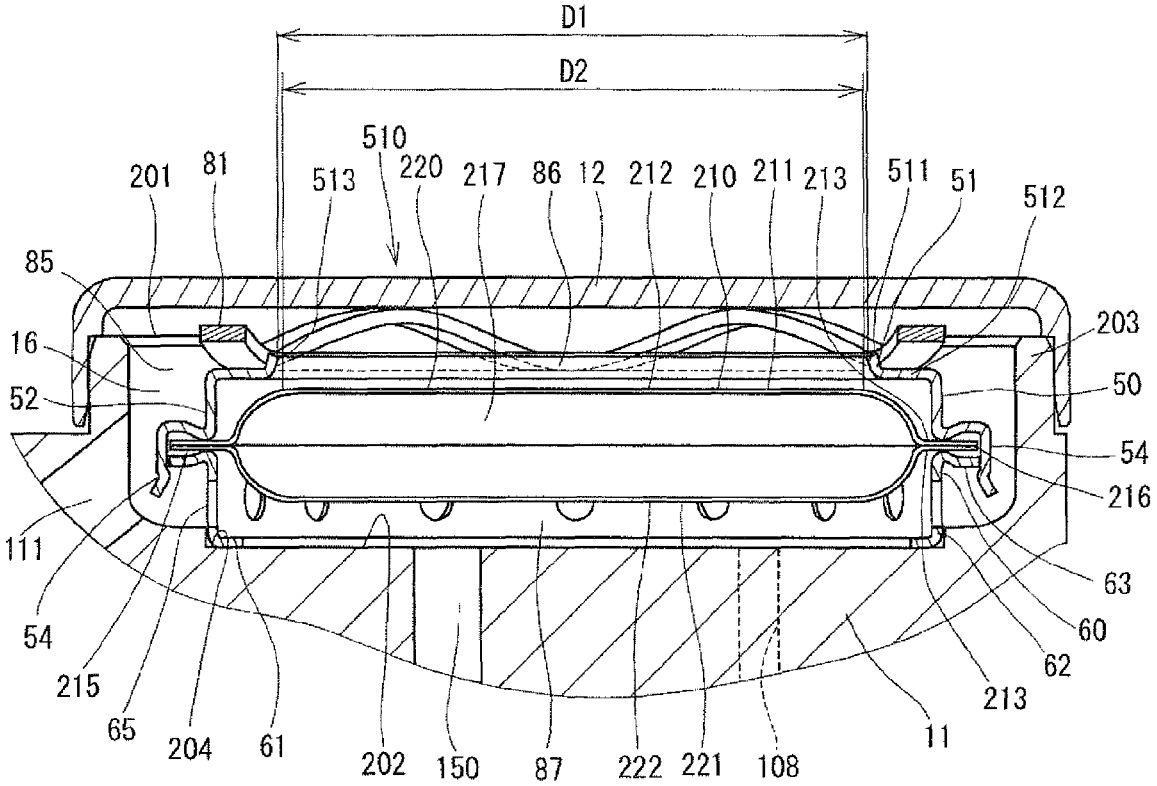
FIG. 13 is a partial enlarged cross-sectional view of a high pressure pump according to the seventh embodiment.

A high pressure pump according to a sixth embodiment of the present invention will be described with reference to FIGS. 10 and 11. The high pressure pump 6 of the sixth embodiment has a structure, which is similar to the structure of the high pressure pump 1 of the first embodiment. FIGS. 10 and 11 substantially correspond to FIGS. 1 and 2, respectively.

Now, the discussion will be made in detail with respect to a damper device 500 of the high pressure pump 6 of the present embodiment, which is similar to the damper device 200 of FIGS. 1 and 2 and thereby reduces the pressure pulsation of fuel induced by the discharging of fuel from the pressurizing chamber 121 into the fluid chamber 16 in the metering stroke. The damper device 500 includes the housing 11, the cover member 12, the damper member 210, the first-side support member 50, the second-side support member 60 and the Belleville spring 80.

The housing 11 includes the tubular portion 203 that is configured into the tubular form at the one end of the tubular portion 203, which is opposite from the plunger 13 placed in the pressurizing chamber 121. The fluid chamber 16 is formed radially inward of the tubular portion 203. The cover member 12 is joined to the outer peripheral wall of the tubular portion 203 by, for example, welding to close the opening 201 of the fluid chamber 16.

The damper member 210, which is provided in the fluid chamber 16, includes the first-side diaphragm 211 and the second-side diaphragm 221.

The outer peripheral edge part of the first-side outer peripheral portion 213 of the first-side diaphragm 211 and the outer peripheral edge part of the second-side outer peripheral portion 223 of the second-side diaphragm 221 are welded together along the entire circumference thereof and thereby form the weld 216. Therefore, the first-side diaphragm 211 and the second-side diaphragm 221 are fluid tightly (air tightly and liquid tightly) sealed together to form the damper chamber 217 between the first-side damper portion 212 and the second-side damper portion 222.

The damper chamber 217 is filled with the gas (such as helium, argon or the mixture of helium and argon) at the predetermined pressure, which is determined based on various factors, such as a demanded value of the fuel pump on the low pressure side, a demanded value of the engine system, the material of the diaphragm, the size of the pressure pulsation. The first-side damper portion 212 and the second-side damper portion 222 are resiliently deformable depending on a change in the pressure of the fluid chamber 16. When the first-side damper portion 212 and the second-side damper portion 222 are resiliently deformed, the volume of the damper chamber 217 is changed to reduce the pressure pulsation at the fluid chamber 16.

Here, a portion of the damper member 210, in which portions of the diaphragms 211, 221 are displaceable (movable or bendable) depending on the fuel pressure exerted in the fluid chamber 16 at the fuel inlet pressure supplied during the normal operation of the high pressure pump, is referred to as a movable portion (also referred to as a bendable portion or a deformably portion) 220 of the damper member 210. The movable portion 220 is configured into a planar form to permit resilient deformation thereof. However, the movable portion 220 is not limited to the planar form and may be configured into any other form (a wavy form, a spherical form), which is other than the planar form.

A spring constant of the damper member 210 is set depending on the required durability or any other required performance of the damper member 210 by appropriately selecting a wall thickness and a material of the first and second-side diaphragms 211, 222 and the pressure of the fluid filled in the damper chamber 217. A frequency of the pressure pulsation to be reduced by the damper member 210 is determined according to this spring constant. Furthermore, the pressure pulsation reducing performance of the damper member 210 varies depending on the volume of the damper chamber 217.

The first-side support member 50 supports the first-side outer peripheral portion 213 of the damper member 210 from the cover member 12 side of the first-side outer peripheral portion 213, and the second-side support member 60 supports the second-side outer peripheral portion 223 of the damper member 210 from the housing 11 side (bottom portion 202 side) of the second-side outer peripheral portion 223. The first-side support member 50 and the second-side support member 60 are urged between the cover member 12 and the housing 11 by the Belleville spring 80, so that the damper member 210 is supported in the fluid chamber 16.

The first-side support member 50 includes the first-side small diameter portion (serving as the annular support portion) 51, the first-side tubular portion 52, the first-side flange portion 53 and the first-side claw portions 54, which are integrated together. The first-side support member 50 is placed between the damper member 210 and the cover member 12.

The first-side small diameter portion 51 includes a guide portion 511 and an urging portion 512. The guide portion 511 is configured into a tubular form. The urging portion 512 radially outwardly projects from the guide portion 511 and is configured into an annular plate form. The guide portion 511 guides an inner peripheral part of the Belleville spring 80, which is placed between the first-side support member 50 and the cover member 12. The urging portion 512 is urged toward the housing 11 (more specifically, the bottom portion 202 of the housing 11) on the housing 11 side (bottom portion 202 side) of the Belleville spring 80.

Here, throughout the specification, the tubular form or the annular form refers to a continuous form, which is continuous along the entire circumference thereof, or alternatively an interrupted form, in which one or more segments thereof are interrupted along the circumference thereof.

An inner diameter D1 of an opening 513 of the guide portion 511 of the first-side small diameter portion 51 is larger than an outer diameter D2 of the movable portion 220 of the damper member 210. Therefore, the guide portion 511 is located radially outward of the movable portion 220 of the damper member 210.

The first-side tubular portion 52 is configured into the tubular form and includes the first-side communication holes 55, which communicate between the outer wall surface and the inner wall surface of the first-side tubular portion 52. A cover member 12 side axial part of the first-side tubular portion 52 is connected with an outer peripheral part of the urging portion 512, and a housing 11 side axial part of the first-side tubular portion 52 is connected with the first-side flange portion 53.

The first-side flange portion 53, which radially outwardly extends from the housing 11 side end part (the damper member 210 side end part) of the first-side tubular portion 52 and is configured into the annular form, supports the first-side outer peripheral portion 213 of the damper member 210.

The second-side support member 60 includes the second-side small diameter portion 61, the second-side tubular portion 62, the second-side flange portion 63 and the second-side claw portions 64, which are formed integrally. The second-side support member 60 is placed between the damper member 210 and the bottom portion 202 of the housing 11.

The second-side tubular portion 62 is configured into the tubular form and includes the second-side communication holes 65, which communicate between the outer wall surface and the inner wall surface of the second-side tubular portion 62. A cover member 12 side axial part of the second-side tubular portion 62 is connected with the second-side flange portion 63, and a bottom portion 202 side axial part of the second-side tubular portion 62 is connected with the second-side small diameter portion 61.

The second-side flange portion 63, which radially outwardly extends from the cover member 12 side end part of the second-side tubular portion 62 and is configured into the annular form, supports the second-side outer peripheral portion 223 of the damper member 210.

The second-side small diameter portion 61, which radially inwardly extends from the housing 11 side end part (bottom portion 202 side end part) of the second-side tubular portion 62 and is configured into the annular form, is fitted into the stepped portion (blind hole, i.e., recess) 204, which is formed in the bottom portion 202 of the housing 11.

The first-side claw portions 54, which radially outwardly extend from the outer peripheral part of the first-side flange portion 53, are bent toward the bottom portion 202 side at tips thereof. The second-side claw portions 64, which radially outwardly extend from the outer peripheral part of the second-side flange portion 63, are bent toward the cover member 12 side at tips thereof.

The first-side claw portions 54 and the second-side claw portions 64 securely hold the weld 216 at the outer peripheral part (outer peripheral edge) of the outer peripheral portion 215 of the damper member 210. Therefore, a radial relative movement of the damper member 210, the first-side support member 50 and the second-side support member 60 relative to each other is limited. The urging portion 512 of the first-side small diameter portion 51, the first-side tubular portion 52 of the first-side support member 50, the second-side tubular portion 62 of the second-side support member 60, and the stepped portion 204 formed at the bottom portion 202 of the housing 11 are axially overlapped with each other, i.e., are located along an imaginary axial line (an imaginary line that is parallel to an axial direction of the first and second-side support members 50, 60, i.e., parallel to a top-to-bottom direction in FIG. 11).

The fluid chamber 16 includes the outer fluid chamber 85, the first-side inner fluid chamber 86 and the second-side inner fluid chamber 87.

The outer fluid chamber 85 is located radially outward of the first and second-side support members 50, 60 and circumferentially surrounds the first and second-side support members 50, 60. An opening of the guide passage 111, which is communicated with the pressurizing chamber 121, is opened in the inner peripheral wall surface of the housing 11. The guide passage 111 is communicated with the outer fluid chamber 85.

The first-side inner fluid chamber 86 is formed at a location radially inward of the first-side support member 50. The first-side inner fluid chamber 86 and the outer fluid chamber 85 are communicated with each other through the first-side communication holes 55, which are formed in the first-side support member 50. Alternatively or additionally, a slit(s) may be provided in the Belleville spring 80 to communicate between the first-side inner fluid chamber 86 and the outer fluid chamber 85.

The second-side inner fluid chamber 87 is formed at the location radially inward of the second-side support member 60. The second-side inner fluid chamber 87 and the outer fluid chamber 85 are communicated with each other through the second-side communication holes 65, which are formed in the second-side tubular member 60.

The fuel inlet, to which the fuel is supplied, is communicated with the second-side inner fluid chamber 87. Therefore, when the fuel, which is discharged from the pressurizing chamber 121 to the fluid chamber 16, is supplied to the outer fluid chamber 85, the fuel is also guided into the first-side inner fluid chamber 86. At this time, the fuel inlet is communicated with the second-side inner fluid chamber 87, so that it is possible to limit the transmission of the pressure pulsation from the fuel inlet to the low pressure fuel conduit.

In the present embodiment, the fuel, which is discharged from the pressurizing chamber 121 to the fluid chamber 16, flows in the circumferential direction in the outer fluid chamber 85, which has the large volume, so that the pressure pulsation can be advantageously reduced. The first-side diaphragm 211 of the damper member 210 reduces the pressure pulsation of the fuel, which flows from the outer fluid chamber 85 to the first-side inner fluid chamber 86 through the first-side communication holes 55 provided in the first-side support member 50. The second-side diaphragm 221 of the damper member 210 reduces the pressure pulsation of the fuel, which flows from the outer fluid chamber 85 to the second-side inner fluid chamber 87 through the second-side communication holes 65 provided in the second-side support member 60. Thereby, it is possible to limit the transmission of the pressure pulsation from the fuel inlet, which is communicated with the second-side inner fluid chamber 87, to the external low pressure fuel conduit.

In the present embodiment, the urging portion 512 of the first-side small diameter portion 51 supports the housing 11 side surface (bottom portion 202 side surface) of the Belleville spring. Therefore, the damper member 210, which is supported by the first-side support member 50 and the second-side support member 60 at the location between the cover member 12 and the housing 11, is fixed, i.e., is securely held at the fluid chamber 16 by the load of the Belleville spring 80. Thereby, it is not required to provide a support element, which supports the Belleville spring 80 from the radially outer side of the Belleville spring 80. Therefore, it is possible to have the large volume of the outer fluid chamber 85, to which the fuel discharged from the pressurizing chamber 121 is supplied. Thus, the pressure increase is limited at the outer fluid chamber 85, and the fluid can be effectively supplied from the outer fluid chamber 85 to the first-side inner fluid chamber 86 and the second-side inner fluid chamber 87. Therefore, it is possible to achieve the high damping performance for damping the pressure pulsation.

The inner peripheral surface of the Belleville spring 80 is supported by the guide portion 511 of the first-side small diameter portion 51. Thereby, the radially positioning function for radially positioning the Belleville spring 80 can be accurately achieved by the guide portion 511. In this way, the resilient deformation of the Belleville spring 80 in the radially outer direction is not limited, and thereby it is possible to limit the occurrence of the biasing of the stress on the Belleville spring 80. As a result, the load is generally uniformly applied from the Belleville spring 80 to the first-side support member 50, and thereby it is possible to limit an occurrence of unintentional deformation of the first-side support member 50, the second-side support member 60 and the damper member 210. Thus, the damper member 210 is reliably functioned to improve the pressure pulsation reducing performance of the damper member 210.

Furthermore, in the present embodiment, the first-side claw portions 54 of the first-side support member 50 and the second-side claw portions 64 of the second-side support member 60 limit the radial relative movement of the damper member 210, the first-side support member 50 and the second-side support member 60 relative to each other. The urging portion 512 of the first-side small diameter portion 51, the first-side tubular portion 52 of the first-side support member 50, the second-side tubular portion 62 of the second-side support member 60, and the stepped portion 204, to which the second-side support member 60 is fitted, are axially overlapped with each other, i.e., are located along the imaginary axial line. Therefore, the first-side support member 50, the damper member 210 and the second-side support member 60 are not displaced relative to each other by the load of the Belleville spring 80, and the load, which is applied from the Belleville spring 80 to the urging portion 512, can be generally uniformly applied to the damper member 210. Thus, it is possible to limit the change in the damper characteristic, which would be caused by tilting of the damper member 210 relative to the axial direction of the first-side support member 50 and the second-side support member 60.

Also, in the present embodiment, the inner diameter D1 of the opening 513 of the guide portion 511 is set to be larger than the outer diameter D2 of the movable portion 220 of the damper member 210. Therefore, for example, in the case where the slits are provided in the Belleville spring 80, the fuel, which is discharged from the pressurizing chamber 121 to the outer fluid chamber 85, can directly act on the movable portion 220 of the damper member 210 upon passing through the slits of the Belleville spring 80 and the opening 513 of the guide portion 511. The fuel, which flows toward the damper member 210 through the opening 513 of the guide portion 511, can be thoroughly guided to the entire region of the movable portion 220 of the damper member 210, and thereby the movable portion 220 can be effectively used to improve the pressure pulsation reducing performance of the damper member 210.

Seventh Embodiment

FIGS. 12 to 15 show a high pressure pump according to a seventh embodiment of the present invention.

In the high pressure pump 7 of the present embodiment, the first-side support member 50 and the second-side support member 60, which support the damper member 210, are urged against the stepped portion 204 of the housing 11 by a wavy spring 81, which serves as an annular resilient member.

In the first-side small diameter portion 51, which is provided on the cover member 12 side of the first-side support member 50, the guide portion 511 supports an inner peripheral surface of the wavy spring 81, and the urging portion 512 supports a housing 11 side surface (lower surface in FIG. 13) of the wavy spring 81.

The first-side claw portions 54 of the first-side support member 50 are fitted to the second-side flange portion 63 of the second-side support member 60. In this way, the first-side support member 50 and the second-side support member 60 are anchored, i.e., are securely held in position while the damper member 210 is clamped between the first-side support member 50 and the second-side support member 60.

The second-side small diameter portion 61, which extends from the bottom portion 202 side of the second-side support member 60 and is configured into an annular form, is fitted to the stepped portion 204, which is formed at the bottom portion 202 of the housing 11. In this way, the urging portion 512 of the first-side small diameter portion 51, the first-side tubular portion 52 of the first-side support member 50, the second-side tubular portion 62 of the second-side support member 60, and the stepped portion 204 of the housing 11, to which the second-side support member 60 is fitted, are axially overlapped with each other, i.e., are located along the imaginary axial line.

The outer peripheral surface of the wavy spring 81 is free, i.e., is not held by any other component(s), so that the outer fluid chamber 58 having the large volume is formed between the outer peripheral surface of the wavy spring 81 and the housing 11. The outer fluid chamber 85 is located radially outward of the first and second-side support members 50, 60 and circumferentially surrounds the first and second-side support members 50, 60. Also, the outer fluid chamber 85 is formed between the bottom portion 202 of the housing 11 and inner surface of the cover member 12 at the location radially outward of the first and second-side support members 50, 60 to surround the first and second-side support members 50, 60.

Figure 14:
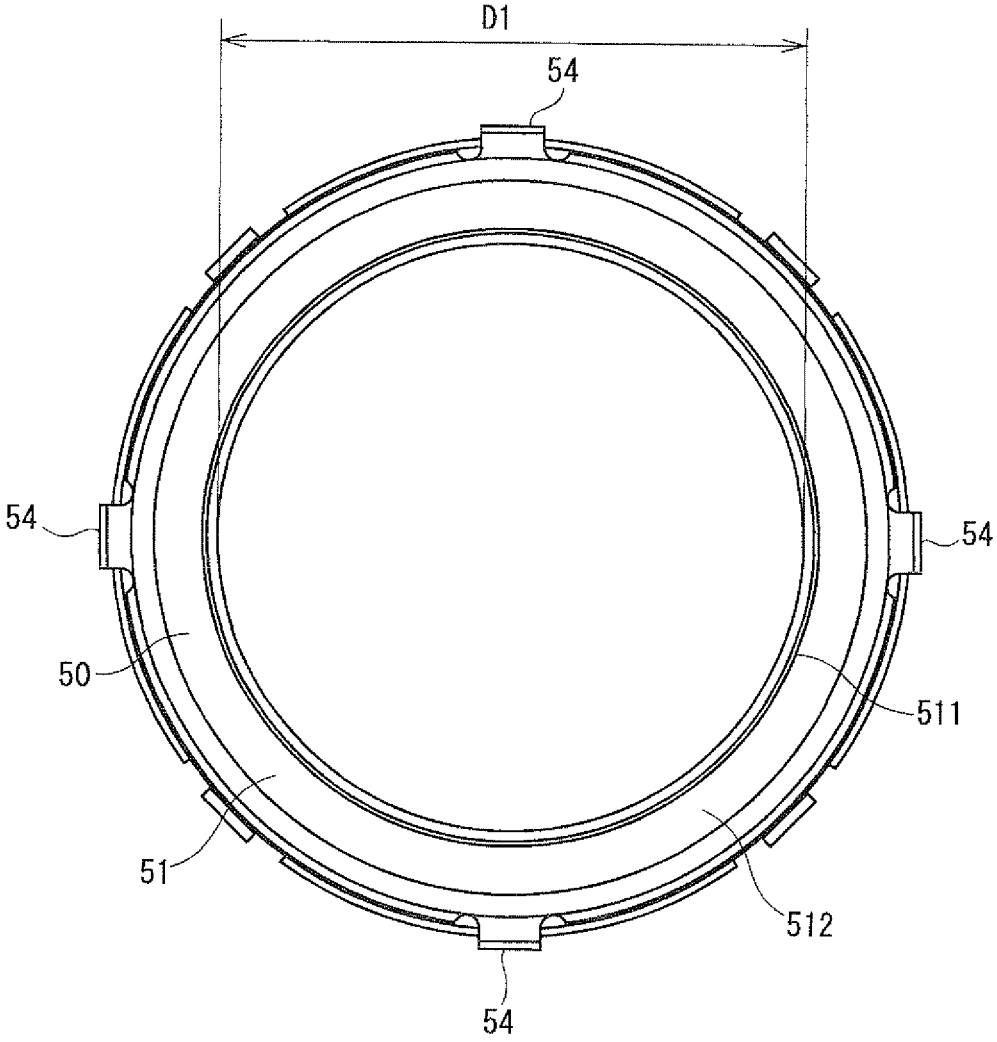
FIG. 14 is a plan view taken in a direction of an arrow XIV in FIG. 12, showing a first-side support member and a second-side support member according to the seventh embodiment.
Figure 15:
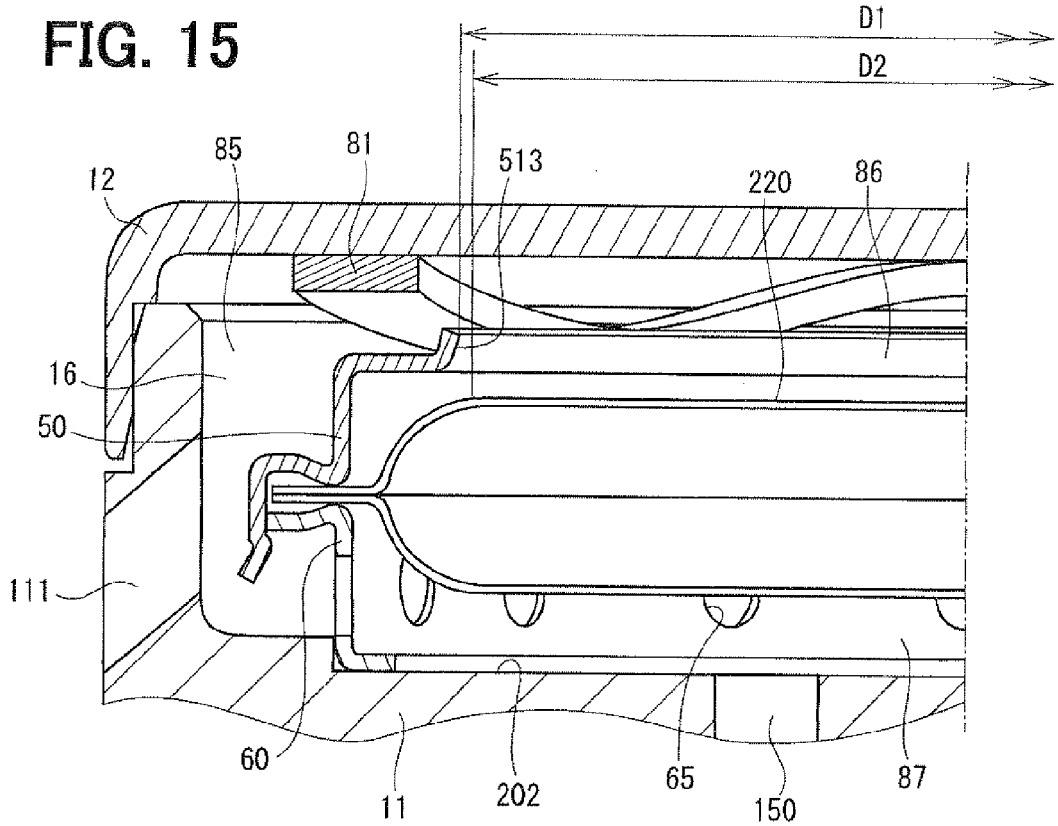
FIG. 15 is a partial enlarged cross-sectional view, showing a portion of the high pressure pump of FIG. 13.

The outer fluid chamber 85 and the first-side inner fluid chamber 86 are communicated with each other through gaps, which are defined between the wavy spring 81 and the cover member 12, and also through gaps, which are defined between the wavy spring 81 and the first-side small diameter portion 51. Furthermore, as shown in FIGS. 14 and 15, the inner diameter D1 of the opening 513, which is located radially inward of the guide portion 511 of the first-side small diameter portion 51, is set to be larger than the outer diameter D2 of the movable portion 220 of the damper member 210. Therefore, the guide portion 511 is provided radially outward of the movable portion 220 of the damper member 210. In this way, the fuel, which is discharged from the pressurizing chamber 121, is supplied from the outer fluid chamber 85 into the first-side inner fluid chamber 86 and directly acts on the movable portion 220 of the damper member 210 upon passing through the opening 513 located at the radially inner part of the guide portion 511. The fuel, which flows from the outer fluid chamber 85 toward the damper member 210 upon passing through the opening 513 of the guide portion 511, can be thoroughly guided to the entire region of the movable portion 220 of the damper member 210. Therefore, the movable portion 220 can be effectively used to improve the pressure pulsation reducing performance of the damper member 210.

A communication passage 150, which is communicated with the fuel inlet that receives the fuel from the low pressure fuel conduit, is opened at the bottom portion 202 of the housing 11. Specifically, the fuel inlet is communicated with the second-side inner fluid chamber 87 located on the side of the damper member 210, which is opposite from the first-side inner fluid chamber 86. In this way, it is possible to limit the transmission of the pressure pulsation from the fuel inlet to the external low pressure fuel conduit.

In the present embodiment, the guide portion 511 supports the inner peripheral surface of the wavy spring 81, and the urging portion 512 supports the housing 11 side surface (bottom portion 202 side surface) of the wavy spring 81.

Therefore, the first-side support member 50, the second-side support member 60 and the damper member 210 are fixed in the fluid chamber 16 by the load of the wavy spring 81 at the location between the cover member 12 and the housing 11. Thereby, it is not required to provide a support element, which supports the wavy spring 81 from the radially outer side of the wavy spring 81. Therefore, it is possible to have the large volume of the outer fluid chamber 85, to which the fuel discharged from the pressurizing chamber 121 is supplied. Thus, the pressure increase is limited at the outer fluid chamber 85, and the fluid can be effectively supplied from the outer fluid chamber 85 to the first-side inner fluid chamber 86 and the second-side inner fluid chamber 87. Therefore, it is possible to achieve the high damping performance for damping the pressure pulsation.

The resilient deformation of the wavy spring 81 in the radially outer direction is not limited, and thereby it is possible to limit the occurrence of the biasing of the stress on the wavy spring 81. As a result, the load is generally uniformly applied from the wavy spring 81 to the first-side support member 50, the second-side support member 60 and the damper member 210 through the urging portion 512, and thereby it is possible to limit an occurrence of unintentional deformation of the first-side support member 50, the second-side support member 60 and the damper member 210. Thus, the damper member 210 is reliably functioned to improve the pressure pulsation reducing performance of the damper member 210.

In the present embodiment, the first-side support member 50 and the second-side support member 60 are anchored, i.e., are securely held while the damper member 210 is clamped between the first-side support member 50 and the second-side support member 60. Therefore, the first-side small diameter portion 51 of the first-side support member 50 is not radially outwardly displaced by the action of the load of the wavy spring 81, and it is possible to provide the generally uniform action of the load of the wavy spring 81.

Furthermore, the urging portion 512 of the first-side small diameter portion 51, the first-side tubular portion 52 of the first-side support member 50, the second-side tubular portion 62 of the second-side support member 60, and the stepped portion 204 of the housing 11, to which the second-side support member 60 is fitted, are axially overlapped with each other, i.e., are located along the imaginary axial line. In this way, the load, which is generally uniformly applied from the wavy spring 81 to the first-side small diameter portion 51, is generally uniformly applied to the damper member 210. In this way, it is possible to limit the change in the damper characteristic, which would be caused by the tilting of the damper member 210 relative to the axial direction of the first-side support member 50 and the second-side support member 60.

In the present embodiment, the wavy spring 81 is used as the annular resilient member. Therefore, the first-side communication holes are not formed in the first-side support member 50. The passages, which guide the fuel that flows toward the damper member 210 through the opening 513 of the first-side small diameter portion 51, can be formed with the wavy spring 81. Therefore, the multiple functions (urging function and passage defining function) can be integrated into the one component to simplify the structure.

Eighth Embodiment

Figure 16:
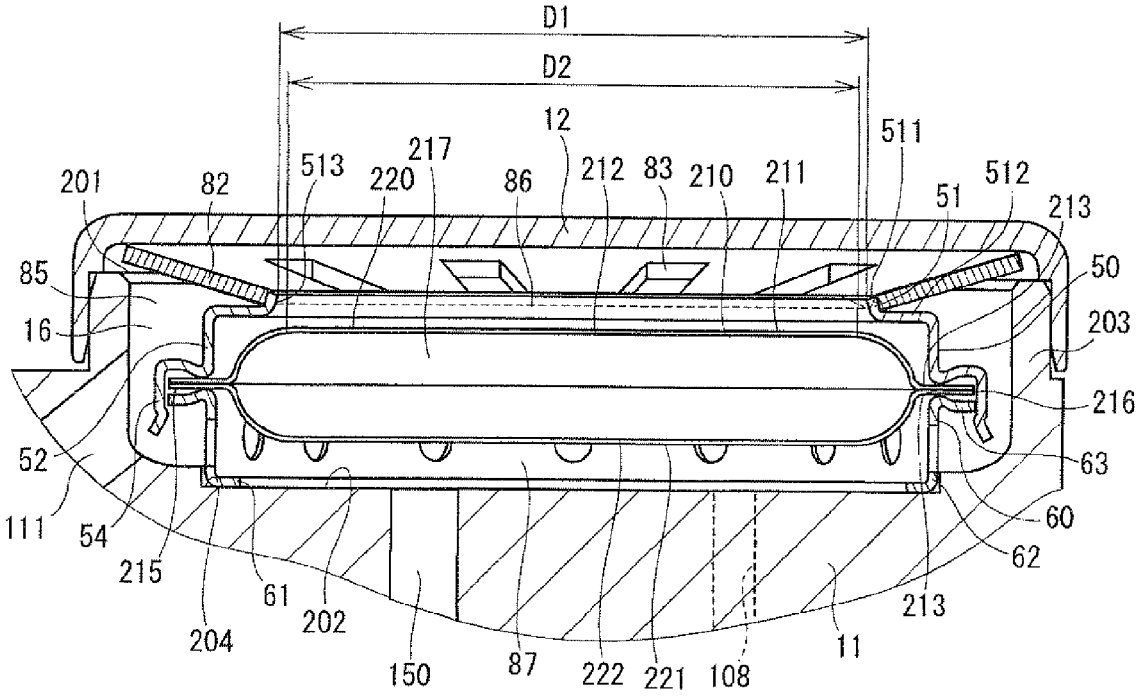
FIG. 16 is a partial enlarged cross-sectional view of a high pressure pump according to an eighth embodiment of the present invention.
Figure 17:
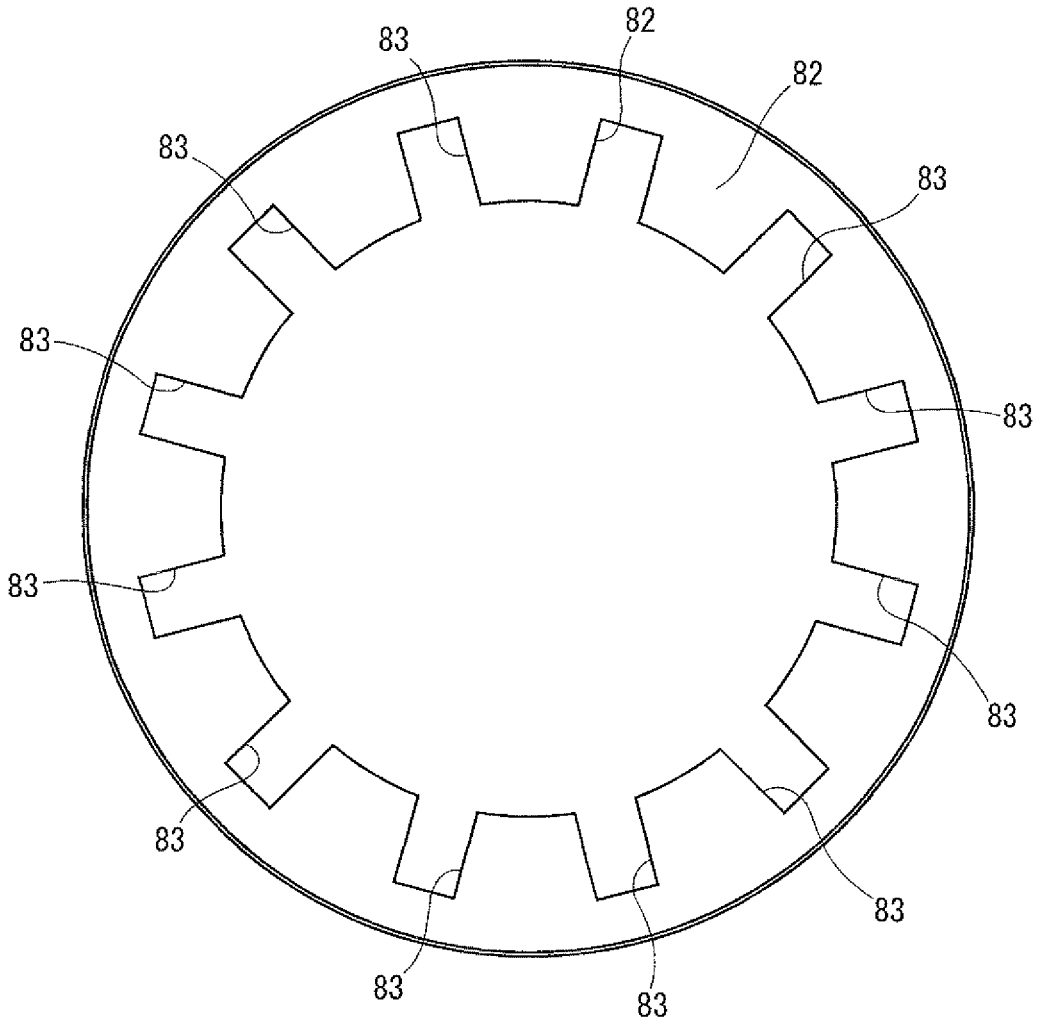
FIG. 17 is a plan view showing a Belleville spring according to the eighth embodiment.

A high pressure pump according to an eighth embodiment of the present invention will be described with reference to FIGS. 16 and 17.

In the high pressure pump 7 of the present embodiment, the first-side support member 50 and the second-side support member 60, which support the damper member 210, are urged against the stepped portion 204 provided in the bottom portion 202 of the housing 11 by a Belleville spring 82, which serves as an annular resilient member.

Slits 83 are formed in the Belleville spring 82. Each slit 83 is radially outwardly recessed from and is radially outwardly recessed from an inner peripheral surface of the Belleville spring 82. The slits 83 are provided one after another at generally equal angular intervals in the circumferential direction. The outer fluid chamber 85 and the first-side inner fluid chamber 86 are communicated with each other through the slits 83.

Alternative to or in addition to the slits 83, each of which is radially outwardly recessed from and is radially outwardly elongated from the inner peripheral surface of the Belleville spring 82, it is possible to provide slits, each of which is radially inwardly recessed from and is radially inwardly elongated from an outer peripheral surface of the Belleville spring 82.

The passages, which guide the fuel that flows toward the damper member 210 through the opening 513 of the first-side small diameter portion 51, can be formed by the Belleville spring 82. Therefore, without providing the first-side communication holes in the first-side support member 50, the multiple functions can be integrated into the one component to simplify the structure.

Thereby, even with this construction, it is possible to achieve advantages similar to those of the sixth or seventh embodiment.

Now, modifications of the above embodiments will be described.

In the above embodiments, the first-side claw portions (serving as the first-side projections of the present invention) are arranged one after another in the circumferential direction. Alternatively, an annular first-side projection, which extends all around the first-side support member, may be formed. In the above embodiments, the second-side claw portions (serving as the second-side projections of the present invention) are arranged one after another in the circumferential direction. Alternatively, an annular second-side projection, which extends all around the second-side support member, may be formed.

In each of the first, sixth, seventh and eighth embodiments, the spring 80, 81, 82 is formed separately from the first-side support member 50 and is installed to the housing 11 after the installation of the first-side support member 50. Alternatively, the spring 80, 81, 82 of each of the first, sixth, seventh and eighth embodiments may be joined to the first-side support member 50 by, for example, welding at the location shown in each corresponding drawing of the corresponding embodiment discussed above to serve as an integral part of the first-side support member 50 or may be formed integrally as a part of the first-side support member 50 by, for example, press working.

The present invention is not limited to the above embodiments and modifications thereof. That is, the above embodiments and modifications thereof may be modified in various ways without departing from the spirit and scope of the invention.

What is claimed is:

1. A high pressure pump comprising:

a plunger that is adapted to reciprocate in an axial direction;

a housing that includes a pressurizing chamber and a fluid chamber, wherein the plunger pressurizes fuel in the pressurizing chamber through reciprocating movement of the plunger, and the pressurizing chamber is communicated with the fluid chamber;

a delivery valve that discharges the fuel, which is pressurized to a predetermined pressure or higher in the pressurizing chamber, through a fuel outlet;

a metering valve that discharges a portion of the fuel from the pressurizing chamber to the fluid chamber by opening or closing a fuel passage, which communicates between the pressurizing chamber and the fluid chamber, when a volume of the pressurizing chamber is reduced by the plunger;

a cover member that covers an opening of the fluid chamber, which is formed in the housing;

a damper member that is placed in the fluid chamber and includes a first-side diaphragm and a second-side diaphragm, wherein a first-side outer peripheral portion of the first-side diaphragm and a second-side outer peripheral portion of the second-side diaphragm are joined together in a joined part thereof to form a sealed damper chamber between the first-side diaphragm and the second-side diaphragm;

a first-side support member that supports the first-side outer peripheral portion of the damper member from a cover member side of the first-side outer peripheral portion in the axial direction at a radial location, which is radially inward of the joined part;

a second-side support member that supports the second-side outer peripheral portion of the damper member from a housing side of the second-side outer peripheral portion in the axial direction at the radial location, which is radially inward of the joined part; and an annular resilient member that is placed between the cover member and the first-side support member to urge the first-side support member against the first-side outer peripheral portion and to urge the second-side support member against the housing through the damper member, wherein:

the first-side support member includes an annular support portion at a cover member side of the first-side support member to support both of an inner peripheral surface and a housing side surface of the annular resilient member;

the annular support portion includes:

a guide portion, which is configured into a tubular form and guides the inner peripheral surface of the annular resilient member; and an urging portion, which radially outwardly projects from the guide portion and is configured into an annular plate form, wherein the housing side surface of the annular resilient member urges the urging portion, the fluid chamber includes an outer fluid chamber, which is located radially outward of the annular support portion and circumferentially extends all around the annular support portion;

the outer fluid chamber is communicated with the pressurizing chamber; and the first-side outer peripheral portion and the second-side outer peripheral portion are clamped in the axial direction between the first-side support member and the second-side member at the radial location, which is radially inward of the joined part, along an entire circumferential extent of the first-side outer peripheral portion and the second-side outer peripheral portion.

2. The high pressure pump according to claim 1, wherein:

the first-side support member and the second-side support member are connected together while the damper member is clamped between the first-side support member and the second-side support member; and the housing includes a recess, into which the second-side support member is fitted.

3. The high pressure pump according to claim 1, wherein:

a first-side tubular portion of the first-side support member and a second-side tubular portion of the second-side support member clamp the damper member therebetween;

the housing includes a recess, into which the second-side support member is fitted;

the urging portion of the annular support portion, the first-side tubular portion of the first-side support member, the second-side tubular portion of the second-side support member and the recess of the housing overlap in the axial direction.

4. The high pressure pump according to claim 1, wherein:

the outer fluid chamber is located radially outward of the annular support portion, the first-side support member and the second-side support member and extends thoroughly from the housing to the cover member in the axial direction.

5. The high pressure pump according to claim 1, wherein the fluid chamber is communicated with a fuel inlet, from which the fuel is supplied.

6. The high pressure pump according to claim 1, wherein:

the outer fluid chamber is located radially outward of the annular support portion, the first-side support member and the second-side support member;

the fluid chamber further includes a first-side inner fluid chamber, which is located radially inward of the first-side support member; and a second-side inner fluid chamber, which is located radially inward of the second-side support member; and the outer fluid chamber is communicated with the first-side inner fluid chamber through an opening, which is located radially inward of the annular support portion.

7. The high pressure pump according to claim 6, wherein the fuel inlet is communicated with the second-side inner fluid chamber, which is located radially inward of the second-side support member.

8. The high pressure pump according to claim 1, wherein the annular resilient member is a wavy spring.

9. The high pressure pump according to claim 1, wherein the annular resilient member is a Belleville spring.

10. The high pressure pump according to claim 6, wherein the guide portion of the annular support portion is located radially outward of a movable portion of the damper member.

11. The high pressure pump according to claim 10, wherein the movable portion is a displaceable part of the first-side diaphragm and a displaceable part of the second-side diaphragm, which are displaceable by a fuel pressure that is exerted in the fluid chamber when the fuel is supplied to the fluid chamber during a normal operation of the high pressure pump.

12. The high pressure pump according to claim 1, wherein at least one of the first-side support member and the second-side support member has at least one through-hole that communicates between an outer wall surface and an inner wall surface thereof to conduct the fuel from the outer fluid chamber toward a corresponding one of the first-side diaphragm and the second-side diaphragm located inside thereof.

13. The high pressure pump according to claim 1, wherein:

the first-side support member has at least one through-hole that communicates between an outer wall surface and an inner wall surface of the first-side support member to conduct the fuel from the outer fluid chamber toward the first-side diaphragm located inside of the first-side support member; and the second-side support member has at least one through-hole that communicates between an outer wall surface and an inner wall surface of the second-side support member to conduct the fuel from the outer fluid chamber toward the second-side diaphragm located inside of the second-side support member.

* * * * *